US008077124B2

(12) United States Patent
Asano

(10) Patent No.: US 8,077,124 B2
(45) Date of Patent: Dec. 13, 2011

(54) IMAGE DISPLAY DEVICE AND METHOD OF DRIVING THE SAME

(75) Inventor: Mitsuru Asano, Kanagawa (JP)

(73) Assignee: Sony Corporation, Tokyo (JP)

( * ) Notice: Subject to any disclaimer, the term of this patent is extended or adjusted under 35 U.S.C. 154(b) by 464 days.

(21) Appl. No.: 12/382,200

(22) Filed: Mar. 11, 2009

(65) Prior Publication Data

US 2009/0256782 A1 Oct. 15, 2009

(30) Foreign Application Priority Data

Apr. 9, 2008 (JP) ..... 2008-101331

(51) Int. Cl.
*G09G 3/30* (2006.01)

(52) U.S. Cl. ..... 345/76; 345/82; 315/169.1

(58) Field of Classification Search ..... 345/55, 345/76–83, 211–213, 690–693; 315/169.1–169.4; 327/74, 77

See application file for complete search history.

(56) References Cited

U.S. PATENT DOCUMENTS

| | | | | |
|---|---|---|---|---|
| 7,528,812 | B2 * | 5/2009 | Tsuge et al. | 345/78 |
| 7,948,456 | B2 * | 5/2011 | Yamashita et al. | 345/82 |
| 2002/0175884 | A1 * | 11/2002 | Kim et al. | 345/76 |
| 2005/0057580 | A1 * | 3/2005 | Yamano et al. | 345/690 |
| 2005/0099368 | A1 * | 5/2005 | Abe et al. | 345/76 |
| 2005/0175606 | A1 * | 8/2005 | Huang et al. | 424/144.1 |
| 2005/0237281 | A1 * | 10/2005 | Tam | 345/76 |
| 2006/0158396 | A1 * | 7/2006 | Jo | 345/76 |
| 2007/0080905 | A1 * | 4/2007 | Takahara | 345/76 |
| 2007/0146251 | A1 * | 6/2007 | Tsuge et al. | 345/76 |
| 2007/0247399 | A1 * | 10/2007 | Yamashita et al. | 345/82 |
| 2007/0268210 | A1 | 11/2007 | Uchino et al. | |

FOREIGN PATENT DOCUMENTS

| | | |
|---|---|---|
| JP | 2007-133284 | 5/2007 |
| JP | 2007-310311 | 11/2007 |
| JP | 2008-033193 A | 2/2008 |
| JP | 2008-033194 A | 2/2008 |
| JP | 2009-109619 A | 5/2009 |
| JP | 2009-122335 A | 6/2009 |
| JP | 2009-122336 A | 6/2009 |
| JP | 2009-128404 A | 6/2009 |

OTHER PUBLICATIONS

Japanese Office Action issued Apr. 13, 2010 for corresponding Japanese Application No. 2008-101331.

* cited by examiner

*Primary Examiner* — Kimnhung Nguyen
(74) *Attorney, Agent, or Firm* — Rader, Fishman & Grauer PLLC

(57) ABSTRACT

An image display device includes a display portion formed by disposing pixel circuits in a matrix, and a signal line driving circuit and a scanning line driving circuit for driving the pixel circuits through signal lines and scanning lines of the display portion. The pixel circuit includes at least: a light emitting element; a drive transistor for current-driving the light emitting element by a drive current corresponding to a gate-to-source voltage thereof; a hold capacitor composed of either one capacitor or a plurality of coupling capacitors for holding therein the gate-to-source voltage; and a write transistor adapted to be turned ON/OFF in accordance with a write signal outputted from the scanning line driving circuit, thereby setting a voltage developed across terminals of the hold capacitor at a voltage of corresponding one of the signal line.

16 Claims, 17 Drawing Sheets

SIGNAL LINE DRIVING CIRCUIT
3
2
D1
1
Ssig(1)
Ssig(2)
Ssig(3)
5
PIXEL CIRCUIT (1, 1)
PIXEL CIRCUIT (1, 2)
PIXEL CIRCUIT (1, 3)
PIXEL CIRCUIT (2, 1)
PIXEL CIRCUIT (2, 2)
PIXEL CIRCUIT (2, 3)
PIXEL CIRCUIT (3, 1)
PIXEL CIRCUIT (3, 2)
PIXEL CIRCUIT (3, 3)
WS
DS
VSCAN1(1)
VSCAN2(1)
VSCAN1(2)
VSCAN2(2)
VSCAN1(3)
VSCAN2(3)
6A
6B
SCANNER
SCANNER
4

IMAGE DISPLAY DEVICE AND METHOD OF DRIVING THE SAME

BACKGROUND OF THE INVENTION

1. Field of the Invention

The present invention relates to an image display device and a method of driving the same. For example, the present invention can be applied to an active matrix type image display device using organic Electro Luminescence (EL) elements. In the present invention, the electric charges originating from which a voltage developed across opposite terminals of a hold capacitor are discharged through a drive transistor, thereby correcting a dispersion of threshold voltages of the drive transistors. In this case, a gate-to-source voltage of the drive transistor is reduced for a time period for which the discharge of the electric charges corresponding to the voltage developed across the opposite terminals of the hold capacitor is temporarily stopped by utilizing running between wiring patterns formed on a substrate. Thus, in the present invention, it is made possible to reliably correct the dispersion of the threshold voltages of the drive transistors even when the discharge of the electric charges corresponding to the voltage developed across the opposite terminals of the hold capacitor is carried out for each of multiple time periods so as to correct the dispersion of the threshold voltages of the drive transistors by discharging the electric charges corresponding to the voltage developed across the opposite terminals of the hold capacitor through the drive transistor.

2. Description of the Related Art

Heretofore, in an active matrix type image display device using organic EL elements, a display portion is formed by disposing pixel circuits each composed of the organic EL element and a drive circuit for driving the organic EL element in a matrix. With this sort of image display device, a signal line driving circuit and a scanning line driving circuit which are disposed in a periphery of the display portion successively drive the pixel elements, thereby displaying a desired image on the display portion.

With regard to the image display device using the organic EL elements, Japanese Patent Laid-Open No. 2007-310311 (hereinafter referred to as Patent Document 1) discloses a method of configuring one pixel circuit by using two transistors. Therefore, according to the method disclosed in Patent Document 1, the configuration can be simplified.

In addition, Patent Document 1 also discloses a configuration with which a dispersion of threshold voltages of drive transistors for driving respective organic EL elements, and a dispersion of mobilities thereof are corrected. Therefore, according to the configuration disclosed in Patent Document 1, it is possible to prevent image quality from being deteriorated due to the dispersion of the threshold voltages of the drive transistors, and the dispersion of the mobilities thereof.

On the other hand, Japanese Patent Laid-Open No. 2007-133284 (hereinafter referred to as Patent Document 2) proposes a configuration with which processing for correcting the dispersion of the threshold voltages is executed for each of the multiple time periods.

Here, with the image display device using the organic EL elements, the organic EL elements are current-driven by using the drive transistors each composed of a Thin Film Transistor (TFT), respectively. Here, the TFT has a disadvantage that there is the large dispersion in the characteristics. In the image display device using the organic EL elements, the image quality is remarkably deteriorated owing to the dispersion, of the thresholds, as one of the dispersions of the characteristics of the drive transistors. It is noted that the deterioration of the image quality is perceived in the form of a streak, non-uniformity of a luminance, or the like.

More specifically, a drive current Ids caused to flow through an organic EL element by a driving operation of a drive transistor is expressed by Expression (1):

$$Ids=(\beta/2)\times(Vgs-Vth)^2 \quad (1)$$

where Vgs is a gate-to-source voltage of the drive transistor, and Vth is a threshold voltage of the drive transistor. In this case, a factor β in Expression (1) is given by Expression (2):

$$\beta=\mu\times(W/L)\times Cox \quad (2)$$

where μ is a mobility of a carrier in the drive transistor, W is a channel width of the drive transistor, L is a channel length of the drive transistor, and Cox is a capacitance of a gate insulating film, per unit area, of the drive transistor.

Therefore, in the image display device using the organic EL elements, when the threshold voltage Vth of the drive transistor disperses, the drive current Ids caused to flow through the organic EL element by the driving operation of the drive transistor disperses accordingly. As a result, an emission luminance disperses every pixel.

Here, Expression (1) is transformed into Expression (3):

$$Vgs=\{Ids\times(2/\beta)\}^{1/2}+Vth \quad (3)$$

Therefore, when the organic EL element is driven with a drive current Iref, the gate-to-source voltage Vref can be expressed by Expression (4):

$$V\mathrm{ref}=\{I\mathrm{ref}\times(2/\beta)\}^{1/2}+Vth \quad (4)$$

Therefore, when a pixel circuit is configured in such a way that the gate-to-source voltage Vgs of the drive transistor is set with a difference voltage Vdata obtained from the voltage Vref, Expression (5) can be obtained:

$$Ids=(\beta/2)\times[V\mathrm{data}-\{I\mathrm{ref}\times(2/\beta)\}^{1/2}]^2 \quad (5)$$

Therefore, in this case, in the image display device, it is possible to avoid an influence which the threshold voltage Vth is exerted on the drive current Ids. Also, it is possible to prevent the emission luminance from dispersing due to the dispersion of the threshold voltages Vth.

It is noted that when Iref=0, Expression (6) can be obtained:

$$Ids=(\beta/2)\times V\mathrm{data}^2 \quad (6)$$

Therefore, in the image display device, even when Iref=0, it is possible to avoid an influence which the threshold voltage Vth is exerted on the drive current Ids. As a result, it is possible to prevent the image quality from being deteriorated. It is noted that when Iref=0, the configuration of the image display device can be simplified because there is no need for providing a current source for the drive current Iref.

With the configuration of the image display device disclosed in Patent Document 1, the dispersion of the threshold voltages of the drive transistors is corrected in accordance with the correction principle described above. Here, FIG. 12 is a block diagram showing an image display device to which the technique disclosed in Patent Document 1 is applied. In the image display device 1, a display portion 2 is formed on a transparent insulating substrate made of a glass or the like. Also, in the image display device 1, a signal line driving circuit 3 and a scanning line driving circuit 4 are provided in the periphery of the display portion 2.

Here, the display portion 2 is formed by disposing the pixel circuits 5 in a matrix. The signal line driving circuit 3 outputs drive signals Ssig for instruction for emission luminances to signal lines provided in the display portion 2. More specifically, after successively latching image data D1 inputted thereto in the order of the raster scanning, and distributing the image data D1 thus latched among the signal lines sig, the signal line driving circuit 3 executes processing for digital-to-analog converting the image data D1 thus distributed, thereby generating the drive signals Ssig. As a result, the image display device 1 sets gradations for the pixel circuits 5, for example, in the so-called line-sequential manner.

The scanning line driving circuit 4 outputs a write signal WS and a drive signal DS to scanning lines VSCAN1 and VSCAN2 provided in the display portion 2, respectively. Here, the write signal WS is a signal in accordance with which a write transistor provided in the pixel circuit 5 is controlled so as to be turned ON/OFF. In addition, the drive signal DS is a signal in accordance with which a drain voltage of a drive transistor provided in the pixel circuit 5 is controlled. The scanning line driving circuit 4 processes a timing signal outputted from a timing generator (not shown) in scanners 6A and 6B, thereby generating the write signal WS and the drive signal DS.

FIG. 13 is a circuit diagram, partly in block, showing a configuration of the pixel circuit 5 in detail. In the pixel circuit 5, a cathode terminal of an organic EL element 8 is connected to a predetermined fixed power source VSS1, and an anode terminal of the organic EL element 8 is connected to a source of a drive transistor Tr3. It is noted that the drive transistor Tr3 is an N-channel transistor, for example, composed of a TFT. Also, in the pixel circuit 5, a drain of the drive transistor Tr3 is connected to the scanning line VSCAN2 for power source supply. Thus, in the pixel circuit 5, the organic EL element 8 is current-driven by using the drive transistor Tr3 having a source follower circuit configuration.

In the pixel circuit 5, a hold capacitor Cs is connected between a gate and the source of the drive transistor Tr3. A voltage at a gate side end of the hold capacitor Cs is set at a voltage corresponding to the drive signal Ssig in accordance with the write signal WS. As a result, in the pixel circuit 5, the organic EL element 8 is current-driven by the drive transistor Tr3 in accordance with the gate-to-source voltage Vgs corresponding to the drive signal Ssig. It is noted that in FIG. 13, a capacitance Coled is a floating capacitance of the organic EL element 8. In addition, in the following description, the Coled is sufficiently larger than that of the hold capacitor Cs, and a parasitic capacitance of a gate node of the drive transistor Tr3 is sufficiently smaller than the capacitance of the hold capacitor Cs.

That is to say, in the pixel circuit 5, the gate of the drive transistor Tr3 is connected to the signal line sig through a write transistor Tr1 which operates so as to be turned ON/OFF in accordance with the write signal WS. Here, the signal line driving circuit 3 switches one of the voltage Vsig for gradation setting, and a fixed voltage Vofs for threshold voltage correction to the other at a predetermined timing through switch circuits 9 and 10 which operate so as to be turned ON in accordance with predetermined control signals SELsig and SELofs, respectively, thereby outputting the drive signal Ssig.

Here, it is noted that the fixed voltage Vofs for threshold voltage correction is a fixed voltage used to correct the dispersion of the threshold voltages Vth of the drive transistors Tr3. In addition, the voltage Vsig for gradation setting is a voltage in accordance with which an emission luminance of corresponding one of the pixels is instructed, and is obtained by adding the fixed voltage Vofs for threshold voltage correction to a gradation voltage Vdata.

In addition, the gradation voltage Vdata is a voltage corresponding to the emission luminance of the pixel circuit 5 connected to the corresponding one of the signal lines sig. After successively latching the image data D1 inputted thereto in the order of the raster scanning, and distributing the image data D1 thus latched among the signal lines sig, a data receiver 6 composed of a semiconductor integrated circuit executes processing for digital-to-analog converting the image data D1 thus distributed, thereby generating the gradation voltage Vdata every signal line sig. It is noted that each of the switch circuits 9 and 10 is composed of a TFT, and is formed together with a wiring pattern composing the signal line sig, and the scanning lines VSCAN1 and VSCAN2 on the transparent insulating substrate having the pixel circuits 5 formed thereon.

In the pixel circuit 5, the write transistor Tr1 is set in an OFF state in accordance with the write signal WS for a time period for which the organic EL element 8 is caused to emit a light (hereinafter referred to as "an emission time period") as indicated by "EMISSION" in a drive state (refer to FIG. 14G) in FIGS. 14A and 14G. In addition, in the pixel circuit 5, a power source voltage VDDV2 is supplied to the drive transistor Tr3 in accordance with the drive signal DS for a power source for the emission time period. As a result, in the pixel circuit 5, the organic EL element 8 is caused to emit a light with the drive current Ids corresponding to the gate-to-source voltage Vgs depending on a gate voltage Vg and a source voltage Vs (refer to FIGS. 14E and 14F) of the drive transistor Tr3 as a voltage developed across the opposite terminals of the hold capacitor Cs for the emission time period (refer to Expression (1)).

In the pixel circuit 5, the drive signal DS for a power source is caused to drop to the fixed voltage VSSV2 at a time point t0 at which the emission time period ends. Here, the fixed voltage VSSV2 is a voltage which is low enough to cause the drain of the drive transistor Tr3 to function as the source thereof, and which is lower than the cathode voltage VSS1 of the organic EL element 8. As a result, in the pixel circuit 5, the electric charges accumulated at the organic EL element 8 side end of the hold capacitor Cs are caused to flow out through the drive transistor Tr3 into the scanning line VSCAN2. As a result, in the pixel circuit 5, the source voltage Vs of the drive transistor Tr3 drops to the fixed voltage VSSV2, thereby stopping the light emission of the organic EL element 8.

In the pixel circuit 5, the switch circuit 10 on the fixed voltage Vofs side is set in an ON state at a predetermined time point t1 next to the time point t0. As a result, in the pixel circuit 5, the voltage of the signal line sig is set at the fixed voltage Vofs (refer to FIG. 14C). After that, in the pixel circuit 5, the write transistor Tr1 is switched from the OFF state over to the ON state in accordance with the write signal WS (refer to FIG. 14A). As a result, in the pixel circuit 5, the gate voltage Vg of the drive transistor Tr3 is set at the fixed voltage Vofs. Here, it is noted that the fixed voltage Vofs is a voltage with which no drive transistor Tr3 is turned ON right after the voltage developed across the opposite terminals of the hold capacitor Cs which will be described later is set at the threshold voltage Vth. Specifically, the fixed voltage Vofs needs to fulfill Expression (7):

$$Vofs < VSS1 + Vtholed + Vth \quad (7)$$

where Vtholed is a threshold voltage of the organic EL element 8.

As a result, in the pixel circuit 5, the gate-to-source voltage Vgs of the drive transistor Tr3 is set at a voltage (Vofs−VSSV2). Here, in the pixel circuit 5, the voltage (Vofs−VSSV2) is set so as to become higher than the threshold voltage Vth of the drive transistor Tr3 in accordance with the setting of the fixed voltages Vofs and VSSV2.

After that, in the pixel circuit 5, the drain voltage of the drive transistor Tr3 is caused to rise to the power source voltage VDDV2 at a time point t2 (refer to FIGS. 14A to 14C). As a result, in the pixel circuit 5, a charge current is caused to flow from the power source VDDV2 into the organic EL element 8 side end of the hold capacitor Cs through the drive transistor Tr3. As a result, in the pixel circuit 5, a voltage Vs at the organic EL element 8 side end of the hold capacitor Cs gradually rises. In this case, it is noted that since in the pixel circuit 5, the fixed voltage Vofs is set so as to fulfill Expression (7), the current caused to flow into the organic EL element 8 through the drive transistor Tr3 is used only to charge both the capacitance Coled of the organic EL element 8, and the hold capacitor Cs. As a result, in the pixel circuit 5, the organic EL element 8 emits no light, and thus only the source voltage Vs of the drive transistor Tr3 simply rises.

Here, when in the pixel circuit 5, a potential difference developed across the opposite terminals of the hold capacitor Cs becomes equal to the threshold voltage Vth of the drive transistor Tr3, the flowing of the charge current into the organic EL element 8 through the drive transistor Tr3 is stopped. Therefore, in this case, when the potential difference developed across the opposite terminals of the hold capacitor Cs becomes equal to the threshold voltage Vth of the drive transistor Tr3, the rising of the source voltage Vs of the drive transistor Tr3 is stopped. As a result, in the pixel circuit 5, the electric charges corresponding to the voltage developed across the opposite terminals of the hold capacitor Cs are discharged through the drive transistor Tr3, and thus the voltage developed across the opposite terminals of the hold capacitor Cs is set at the threshold voltage Vth of the drive transistor Tr3.

When in the pixel circuit 5, at a time point t3 is reached after a lapse of time enough to set the voltage developed across the opposite terminals of the hold capacitor Cs at the threshold voltage Vth of the drive transistor Tr3, the write transistor Tr1 is switched from the ON state to the OFF state in accordance with the write signal WS (refer to FIG. 14A). As a result, in the pixel circuit 5, the voltage developed across the opposite terminals of the hold capacitor Cs is reduced for a time period from the time point t2 to the time point t3 to be set at the threshold voltage Vth of the drive transistor Tr3.

In the pixel circuit 5, after the switch circuit 10 on the side of the fixed voltage Vofs is subsequently switched from the ON state to the OFF state, the switch 9 on the side of the voltage Vsig for gradation setting is set in the ON state (refer to FIGS. 14C and 14D). As a result, in the pixel circuit 5, the voltage of the signal line sig is set at the voltage Vsig for gradation setting. In addition, in the pixel circuit 5, the write transistor Tr1 is set in the ON state at a time point t4 following the time point t3. As a result, in the pixel circuit 5, the gate voltage Vg of the drive transistor Tr3 gradually rises from the state in which the potential difference developed across the opposite terminals of the hold capacitor Cs is set at the threshold voltage Vth of the drive transistor Tr3 to be set at the voltage Vsig for gradation setting. As a result, in the pixel circuit 5, as previously stated with respect to Expression (7), the gate-to-source voltage Vgs of the drive transistor Tr3 is set at the difference voltage Vdata obtained based on the voltage Vref. As a result, in the pixel circuit 5, it is possible to prevent the drive current Ids from dispersing due to the dispersion of the threshold voltages Vth of the drive transistors Tr3. Thus, it is possible to prevent the dispersion of the emission luminances.

In the pixel circuit 5, while the drain voltage of the drive transistor Tr3 is held at the power source voltage VDDV2, for a given time period Tμ, the gate of the drive transistor Tr3 is connected to the signal line sig, so that the gate voltage Vg of the drive transistor Tr3 is set at the voltage Vsig for gradation setting. As a result, in the pixel circuit 5, the dispersion of the mobilities μ of the drive transistors Tr3, together with this operation, are corrected.

Here, a write time constant necessary for rising of the gate voltage Vg of the drive transistor Tr3 made through the write transistor Tr1 is set so as to be shorter than a time constant necessary for rising of the source voltage Vs by the driving operation of the drive transistor Tr3. In the following description, the write time constant necessary for rising of the gate voltage Vg of the drive transistor Tr3 is assumed to be negligibly smaller than the time constant necessary for rising of the source voltage Vs.

In this case, when the write transistor Tr1 is turned ON, the gate voltage Vg of the drive transistor Tr3 rapidly rises to the voltage Vsig (Vofs+Vdata) for gradation setting. In the phase of the rising of the gate voltage Vg, when the capacitance Coled of the organic EL element 8 is sufficiently larger than that of the hold capacitor Cs, no source voltage Vs of the drive transistor Tr3 changes.

However, when the gate-to-source voltage Vgs of the drive transistor Tr3 increases to exceed the threshold voltage Vth, the drive current Ids is caused to flow from the power source VDDV2 through the drive transistor Tr3, so that the source voltage Vs of the drive transistor Tr3 gradually rises. As a result, in the pixel circuit 5, the electric charges corresponding to the voltage developed across the hold capacitor Cs are discharged through the drive transistor Tr3, so that a rising speed of the gate-to-source voltage Vgs decreases.

The discharging speed of the electric charges corresponding to the voltage developed across the hold capacitor Cs changes depending on a capability of the drive transistor Tr3. More specifically, the discharging speed increases as the mobility μ of the drive transistor Tr3 becomes larger. It is noted that the drive current Ids of the drive transistor Tr3 on which the discharging speed depends can be expressed by Expression (8):

$$Ids=(\beta/2)\times\{(1/V\text{data})+(\beta/2)\times(T\mu/C)\}^{-2} \quad (8)$$

where C is given by (Cs+Coled).

As a result, in the pixel circuit 5, the setting is made in such a way that the voltage developed across the opposite terminals of the hold capacitor Cs is further reduced in the drive transistor Tr3 having the larger mobility μ. Thus, the dispersion of the emission luminances caused by the dispersion of the mobilities is corrected. In the pixel circuit 5, after a lapse of the time period Tμ, the write signal WS is caused to drop, and the switch circuit 9 on the side of the voltage Vsig for gradation setting is switched from the ON state to the OFF state. As a result, in the pixel circuit 5, the emission time period starts, and the organic EL element 8 is caused to emit a light by the drive current corresponding to the voltage developed across the opposite terminals of the hold capacitor Cs. It is noted that at this time, the power source voltage VDDV2 needs to be set so that the drive transistor Tr3 operates in a saturated region. More specifically, the power source voltage VDDV2 needs to be set so as to fulfill a relationship of {VDDV2>VEL+(Vgs−Vth)}.

SUMMARY OF THE INVENTION

Now, in the pixel circuit 5 shown in FIG. 13, the voltage developed across the opposite terminals of the hold capacitor Cs is set at the threshold voltage Vth of the drive transistor Tr3 in advance before the voltage Vsig for gradation setting is set. As a result, the dispersion of the threshold voltages Vth of the drive transistors Tr3 is corrected. In addition, the processing for setting the voltage developed across the opposite terminals of the hold capacitor Cs at the threshold voltage Vth of the drive transistor Tr3 in advance is executed by discharging the electric charges corresponding to the voltage developed across the opposite terminals of the hold capacitor Cs through the threshold voltage Vth for a time period from the time point t2 to the time point t3.

Therefore, when at a time period from the time point t2 to the time point t3 which can be allocated to the pixels for one line becomes short, for example, owing to the high resolution promotion, in the pixel circuit 5, it becomes difficult to properly set the voltage developed across the opposite terminals of the hold capacitor Cs at the threshold voltage Vth of the drive transistor Tr3. As a result, in the pixel circuit 5, it becomes impossible to sufficiently correct the deterioration of the image quality due to the dispersion of the threshold voltages Vth of the drive transistors Tr3. Therefore, in such a case, by applying the technique disclosed in Patent Document 2, the processing for setting the voltage developed across the opposite terminals of the hold capacitor Cs at the threshold voltage Vth of the drive transistor Tr3 is executed for multiple time periods, thereby making it possible to prevent the deterioration of the image quality.

That is to say, FIGS. 15A to 15F are a time chart explaining the operation of the pixel circuit 5 when the technique disclosed in Patent Document 2 is applied to the image display device 1 described above with reference to FIG. 13 in contrast with the case of the configuration of the image display device 1 shown in FIG. 13. It is noted that in FIGS. 15A to 15F, data (refer to FIG. 15C) is the voltage Vsig (Vdata+Vofs) for gradation setting. Therefore, in an image display device of an example in FIGS. 15A to 15F, a signal line driving circuit alternately outputs the voltages Vsig (Vdata+Vofs) for the respective signal lines, and the fixed voltage Vth for threshold correction to the signal lines sig.

In this example of FIGS. 15A to 15F, as indicated by "PREPARATION," the voltage developed across the opposite terminals of the hold capacitor Cs is set at a voltage equal to or higher than the threshold voltage Vth of the drive transistor Tr3 by using the fixed voltage Vofs right before the voltage Vsig for gradation setting for an adjacent line in a way that the voltages Vsig for gradation setting are set in the respective pixel circuits, for example, in a line-sequential manner. In addition, after that, as indicated by "Vth CORRECTION," the electric charges corresponding to the voltage developed across the opposite terminals of the hold capacitor Cs are discharged through the drive transistor Tr3. In addition, subsequently, for a time period T1 for which the voltage of the signal line sig is set at the voltage Vsig for gradation setting for the adjacent line, the write transistor Tr1 is set in the OFF state in accordance with the write signal WS, thereby temporarily stopping the discharge of the electric charges corresponding to the voltage developed across the opposite terminals of the hold capacitor Cs.

In addition, subsequently, for a time period for which the voltage of the signal line sig is set at the fixed voltage Vofs right before the voltage Vsig for gradation setting for the adjacent line, the write transistor Tr1 is set in the ON state, thereby discharging the electric charges corresponding to the voltage developed across the opposite terminals of the hold capacitor Cs through the drive transistor Tr3. In addition, subsequently, for a time period T2 for which the voltage of the signal line sig is set at the voltage Vsig for gradation setting for the adjacent line, the write transistor Tr1 is set in the OFF state in accordance with the write signal WS, thereby temporarily stopping the discharge of the electric charges corresponding to the voltage developed across the opposite terminals of the hold capacitor Cs.

In addition, subsequently, for a time period for which the signal line sig having the voltage Vsig for gradation setting for the pixel circuit 5 concerned is set at the fixed voltage Vofs, the write transistor Tr1 is set in the ON state, thereby discharging the electric charges corresponding to the voltage developed across the opposite terminals of the hold capacitor Cs through the drive transistor Tr3. Therefore, in the example of FIGS. 15A to 15F, the processing for setting the voltage developed across the opposite terminals of the hold capacitor Cs at the threshold voltage Vth of the drive transistor Tr3 is executed for the three time periods. It is noted that in the following description, the time periods T1 and T2 for each of which the processing for discharging the electric charges corresponding to the voltage developed across the opposite terminals of the hold capacitor Cs through the drive transistor Tr3 is temporarily stopped are each referred to as "a pause time period."

When the processing for setting the voltage developed across the opposite terminals of the hold capacitor Cs at the threshold voltage Vth of the drive transistor Tr3 is executed for the multiple time periods in the manner as described above, even in the case of realizing the high resolution, the electric charges corresponding to the voltage developed across the opposite terminals of the hold capacitor Cs can be discharged through the drive transistor Tr3 for the time period sufficiently ensured. Therefore, the voltage developed across the opposite terminals of the hold capacitor Cs can be properly set at the threshold voltage Vth of the drive transistor Tr3.

With the configuration explained with reference to FIGS. 15A to 15F, however, for each of the pause time periods T1 and T2, the charge current is caused to flow into the source side end of the hold capacitor Cs through the drive transistor Tr3. As a result, in the pixel circuit 5, the source voltage Vs of the drive transistor Tr3 gradually rises for each of the pause time periods T1 and T2. In addition, in the pixel circuit 5, the gate voltage Vg of the drive transistor Tr3 gradually rises in conjunction with the rise of the source voltage Vs.

Here, when the voltage developed across the opposite terminals of the hold capacitor Cs is sufficiently near the threshold voltage Vth of the drive transistor Tr3 in the phase of start of each of the pause time periods T1 and T2, the rise of each of the gate voltage Vg and the source voltage Vs for each of the pause time periods T1 and T2 can be disregarded.

However, when the voltage developed across the opposite terminals of the hold capacitor Cs is not sufficiently near the threshold voltage Vth of the drive transistor Tr3 in the phase of start of each of the pause time periods T1 and T2, the rise of each of the gate voltage Vg and the source voltage Vs for each of the pause time periods T1 and T2 cannot be disregarded. As a result, when the write transistor Tr1 is turned ON in accordance with the write signal WS at a time point of end of each of the pause time periods T1 and T2, thereby setting the gate voltage Vg of the drive transistor Tr3 at the fixed voltage Vofs, it is feared that the voltage developed across the opposite terminals of the hold capacitor Cs drops to the voltage equal to or lower than the threshold voltage Vth of the drive transistor Tr3. In this case, the pixel circuit 5 involves a problem that the dispersion of the threshold voltages Vth of the drive transistors Tr3 cannot be properly corrected. That is to say, in this case, the processing for correcting the dispersion of the threshold voltages Vth of the drive transistors Tr3 is failed.

With regard to one method of solving the above problem, as shown in FIGS. 16A to 16F in contrast with the case explained with reference to FIGS. 15A to 15F, it is expected that the voltage of the signal line sig is caused to drop to the voltage Vofs2 lower than the fixed voltage Vofs right before start of each of the pause time periods T1 and T2, thereby sufficiently reducing the voltage developed across the opposite terminals of the hold capacitor Cs for each of the pause time periods T1 and T2. In this case, the rise of each of the gate voltage Vg and the source voltage Vs for each of the pause time periods T1 and T2 can be sufficiently disregarded.

In addition, when each of the pause time periods T1 and T2 ends, the gate voltage of the drive transistor Tr3 is caused to drop from the voltage Vofs2 to the fixed voltage Vofs. As a result, the voltage developed across the opposite terminals of the hold capacitor Cs can be returned back to the voltage right before the voltage of the signal line sig is caused to drop to the voltage Vofs2. Therefore, after a lapse of each of the pause time periods T1 and T2, it is possible to restart the processing for setting the voltage developed across the opposite terminals of the hold capacitor Cs at the threshold voltage Vth of the drive transistor Tr3. It is noted that FIGS. 17A to 17M are a time chart explaining the operation of the pixel circuit in the continuous line in contrast with the case explained with reference to FIGS. 16A to 16F. Therefore, according to the example explaining with reference to FIGS. 16A to 16F, even when the processing for setting the voltages developed across the opposite terminals of the hold capacitor Cs at the threshold voltage Vth of the drive transistor Tr3 is executed for multiple time periods, the voltages developed across the opposite terminals of the hold capacitor Cs can be properly set at the threshold voltage Vth of the drive transistor Tr3.

However, with the configuration explaining with reference to FIGS. 16A to 16F, the voltage of the signal line sig needs to be switched from one of the voltages Vofs, Vofs2 and Vsig over to another one. As a result, there is a disadvantage that the configuration of the signal line driving circuit for driving the signal lines sig is complicated. In addition, in the case of realizing the high resolution, the operating speed of the signal line driving circuit need to be speeded up. As a result, there is a disadvantage that it is difficult to sufficiently ensure the switching speed. In addition, there is also a disadvantage that the power consumption increases all the more because the voltage of the signal line sig is set at the voltage Vofs2.

In the light of the foregoing, it is therefore desirable to provide an image display device in which a dispersion of threshold voltages of drive transistors can be reliably corrected even when discharge of electric charges corresponding to a voltage developed across opposite terminals of a hold capacitor is carried out for multiple time periods so as to correct the dispersion of the threshold voltages of the drive transistors by discharging the electric charges corresponding to the voltage developed across the opposite terminals of the hold capacitor, and a method of driving the same.

In order to attain the desire described above, according to an embodiment of the present invention, there is provided an image display device having a display portion formed by disposing pixel circuits in a matrix, and a signal line driving circuit and a scanning line driving circuit for driving the pixel circuits through signal lines and scanning lines of the display portion, the display portion, the signal line driving circuit and the scanning line driving circuit being formed on an insulating substrate. The pixel circuit includes at least: a light emitting element; a drive transistor for current-driving the light emitting element by a drive current corresponding to a gate-to-source voltage thereof; a hold capacitor composed of either one capacitor or a plurality of coupling capacitors for holding therein the gate-to-source voltage; and a write transistor adapted to be turned ON/OFF in accordance with a write signal outputted from the scanning line driving circuit, thereby setting a voltage developed across terminals of the hold capacitor at a voltage of corresponding one of the signal lines. The signal line driving circuit alternately outputs a voltage for gradation setting used to instruct a gradation of the pixel circuit connected to the corresponding one of the signal lines, and a fixed voltage for threshold voltage correction to the corresponding one of the signal lines. In the pixel circuit, the write transistor is turned ON to set the voltage developed across the terminals of the hold capacitor at the fixed voltage, thereby setting the voltage developed across the terminals of the hold capacitor at a voltage equal to or higher than a threshold voltage of the drive transistor. Thereafter, a discharging operation for discharging electric charges corresponding to the voltage developed across the terminals of the hold capacitor through the drive transistor in a state in which the write transistor is turned ON to hold a voltage at one terminal of the hold capacitor at a given voltage for a time period for which a voltage of the corresponding one of the signal lines is set at the fixed voltage, and a turn-OFF operation of the write transistor for a time period for which the corresponding one of the signal lines is set at the voltage for gradation setting are repetitively carried out. The discharging operation is carried out at least twice or more, thereby setting the voltage developed across the terminals of the hold capacitor at a voltage depending on the threshold voltage of the drive transistor. Thereafter, the write transistor is turned ON, thereby setting the voltage developed across the terminals of the hold capacitor at the voltage for gradation setting. For a time period for which the voltage of the corresponding one of the signal lines is set at the voltage for gradation setting within a time period from a time point at which the voltage developed across the terminals of the hold capacitor is set at the voltage equal to or higher than the threshold voltage to a time point at which the voltage developed across the terminals of the hold capacitor is set at the voltage for gradation setting, the voltage developed across the terminals of the hold capacitor is made variable from the fixed voltage by utilizing running between wiring patterns formed on the insulating substrate, thereby reducing the gate-to-source voltage of the write transistor as compared with that at a time point of end of the time period for which the voltage of the corresponding one of the signal lines is set at the fixed voltage.

According to another embodiment of the present invention, there is provided a method of driving an image display device having a display portion formed by disposing pixel circuits in a matrix, and a signal line driving circuit and a scanning line driving circuit for driving the pixel circuits through signal lines and scanning lines of the display portion, the display portion, the signal line driving circuit and the scanning line driving circuit being formed on an insulating substrate. The pixel circuit includes at least: a light emitting element; a drive transistor for current-driving the light emitting element by a drive current corresponding to a gate-to-source voltage thereof; a hold capacitor composed of either one capacitor or a plurality of coupling capacitors for holding therein the gate-to-source voltage; and a write transistor adapted to be turned ON/OFF in accordance with a write signal outputted from the scanning line driving circuit, thereby setting a voltage developed across terminals of the hold capacitor at a voltage of corresponding one of the signal lines. The driving method includes the steps of: alternately outputting a voltage for gradation setting used to instruct a gradation of the pixel circuit connected to the corresponding one of the signal lines, and a fixed voltage for threshold voltage correction from the signal line driving circuit to the corresponding one of the signal lines; and turning ON the write transistor to set the voltage developed across the terminals of the hold capacitor at the fixed voltage, thereby setting the voltage developed across the terminals of the hold capacitor at a voltage equal to or higher than a threshold voltage of the drive transistor. The method further includes the steps of: repetitively carrying out a discharging operation for discharging electric charges corresponding to the voltage developed across the terminals of the hold capacitor through the drive transistor in a state in which the write transistor is turned ON to hold a voltage at one terminal of the hold capacitor at a given voltage for a time period for which a voltage of the corresponding one of the signal lines is set at the fixed voltage, and a turn-OFF operation of the write transistor for a time period for which the voltage of the corresponding one of the signal lines is set at the voltage for gradation setting so as to follow the second step, and carrying out the discharging operation at least twice or more, thereby setting the voltage developed across the terminals of the hold capacitor at a voltage depending on the threshold voltage of the drive transistor; and turning ON the write transistor so as to follow the third step, thereby setting the voltage developed across the terminals of the hold capacitor at the voltage for gradation setting; in which in the third step, for a time period for which the voltage of the corresponding one of the signal lines is set at the voltage for gradation setting, the voltage developed across the terminals of the hold capacitor is made variable from the fixed voltage by utilizing running between wiring patterns formed on the insulating substrate, thereby reducing the gate-to-source voltage of the write transistor as compared with that at a time point of end of the time period for which the voltage of the corresponding one of the signal lines is set at the fixed voltage.

According to either the embodiment or the another embodiment of the present invention, by holding the gate-to-source voltage of the drive transistor by the hold capacitor, the light emitting element can be driven so as to emit a light with the drive current corresponding to the voltage developed across the terminals of the hold capacitor by the driving operation of the drive transistor. In addition, after the voltage developed across the terminals of the hold capacitor is set at the voltage equal to or higher than the threshold voltage of the drive transistor, the electric charges corresponding to the voltage developed across the terminals of the hold capacitor are discharged, thereby setting the voltage developed across the terminals of the hold capacitor at the threshold voltage of the drive transistor. After that, the voltage for gradation setting is set, thereby making it possible to prevent the emission luminances from dispersing due to the dispersion of the threshold voltages of the drive transistors. In addition, when the electric charges corresponding to the voltage developed across the terminals of the hold capacitor are discharged through the drive transistor, for the time period for which the voltage of the corresponding one of the signal lines is set at the voltage for gradation setting, the write transistor is turned OFF, which results in that the processing for discharging the electric charges corresponding to the voltage developed across the terminals of the hold capacitor through the drive transistor is executed for the multiple time periods for each of which the voltage of the corresponding one of the signal lines is set at the fixed voltage. As a result, the electric charges corresponding to the voltage developed across the terminals of the hold capacitor can be discharged for the sufficient time period ensured. Thus, it is possible to cope with the high resolution promotion or the like. In addition, when the write transistor is turned OFF for the time period for which the voltage of the corresponding one of the signal lines is set at the voltage for gradation setting, the voltage developed across the terminals of the hold capacitor is made variable from the fixed voltage by utilizing the running between the wiring patterns formed on the insulating substrate, thereby reducing the gate-to-source voltage of the write transistor. As a result, it is possible to prevent each of the gate voltage and the source voltage of the write transistor from rising for this time period without providing a special configuration. Therefore, the threshold voltage can be prevented from being failed, thereby reliably correcting the dispersion of the threshold voltages of the drive transistors.

According to embodiments of the present invention, the dispersion of the threshold voltages of the drive transistors can be reliably corrected even when the discharge of the electric charges corresponding to the voltage developed across the terminals of the hold capacitor through the drive transistor is carried out for the multiple time periods so as to correct the dispersion of the threshold voltages of the drive transistors by discharging the electric charges corresponding to the voltage developed across the terminals of the hold capacitor through the drive transistor.

DETAILED DESCRIPTION OF THE PREFERRED EMBODIMENTS

Preferred embodiments of the present invention will be described in detail hereinafter with reference to the accompanying drawings.

Embodiment 1

(1) Constitution of Embodiment 1

Figure 2:
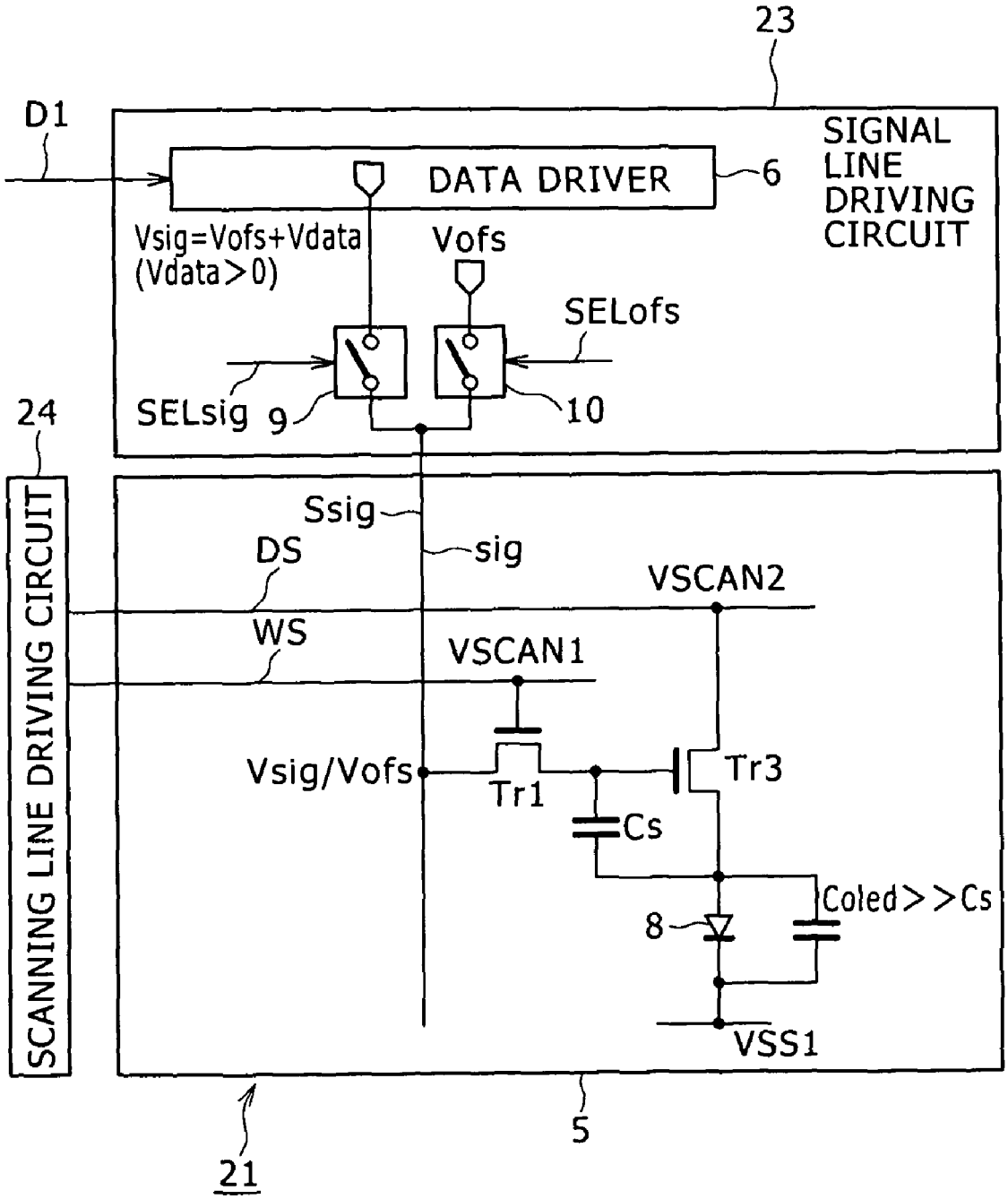
FIG. 2 is a circuit diagram, partly in block, showing a configuration of the pixel circuit explained with reference to FIGS. 1A to 1F.
Figures 3A, 3B, 3C, 3D, 3E, 3F:
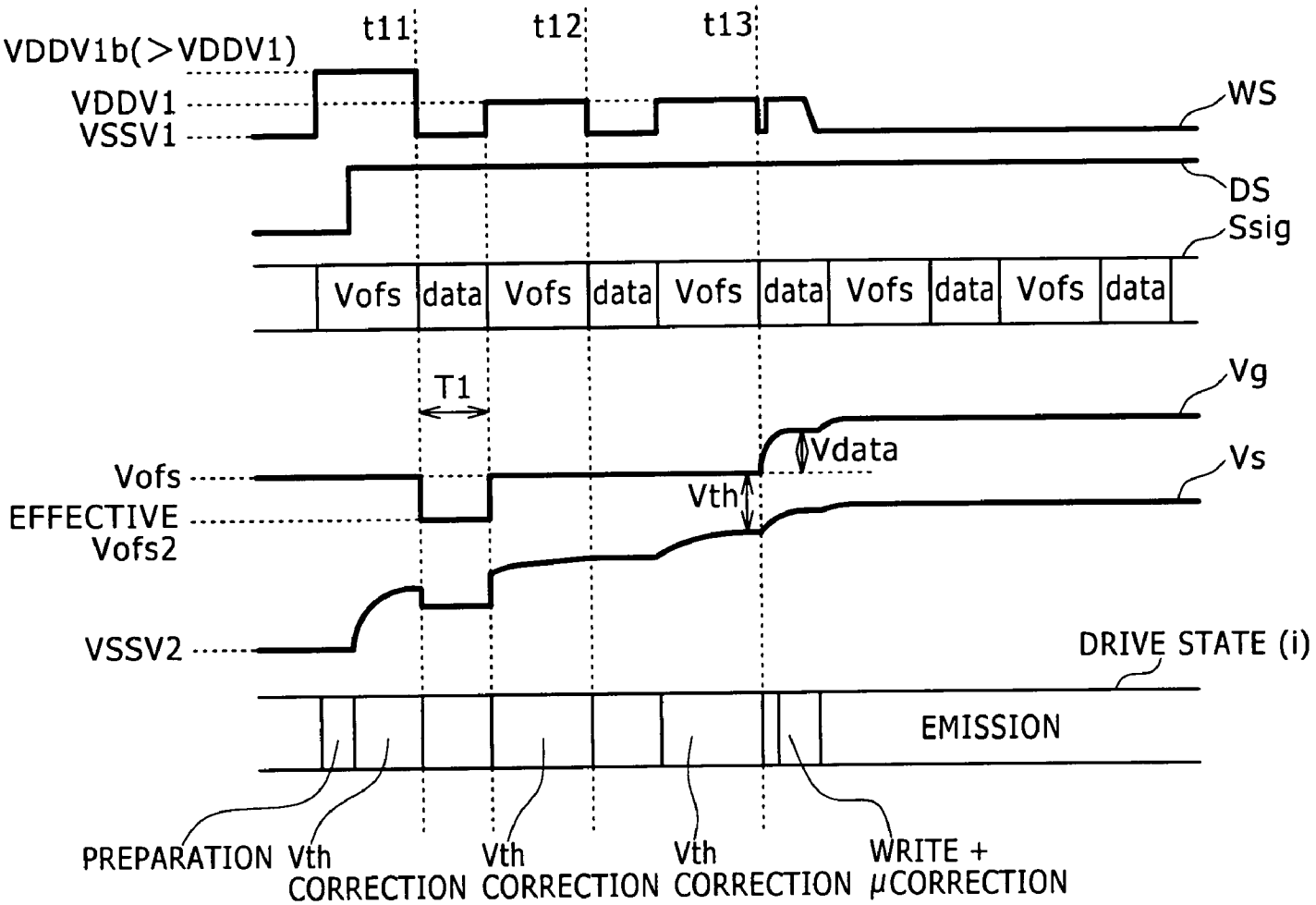
FIGS. 3A to 3F are a time chart explaining an operation of a pixel circuit which is applied to an image display device according to Embodiment 2 of the present invention.
Figures 4A, 4B, 4C, 4D, 4E, 4F:
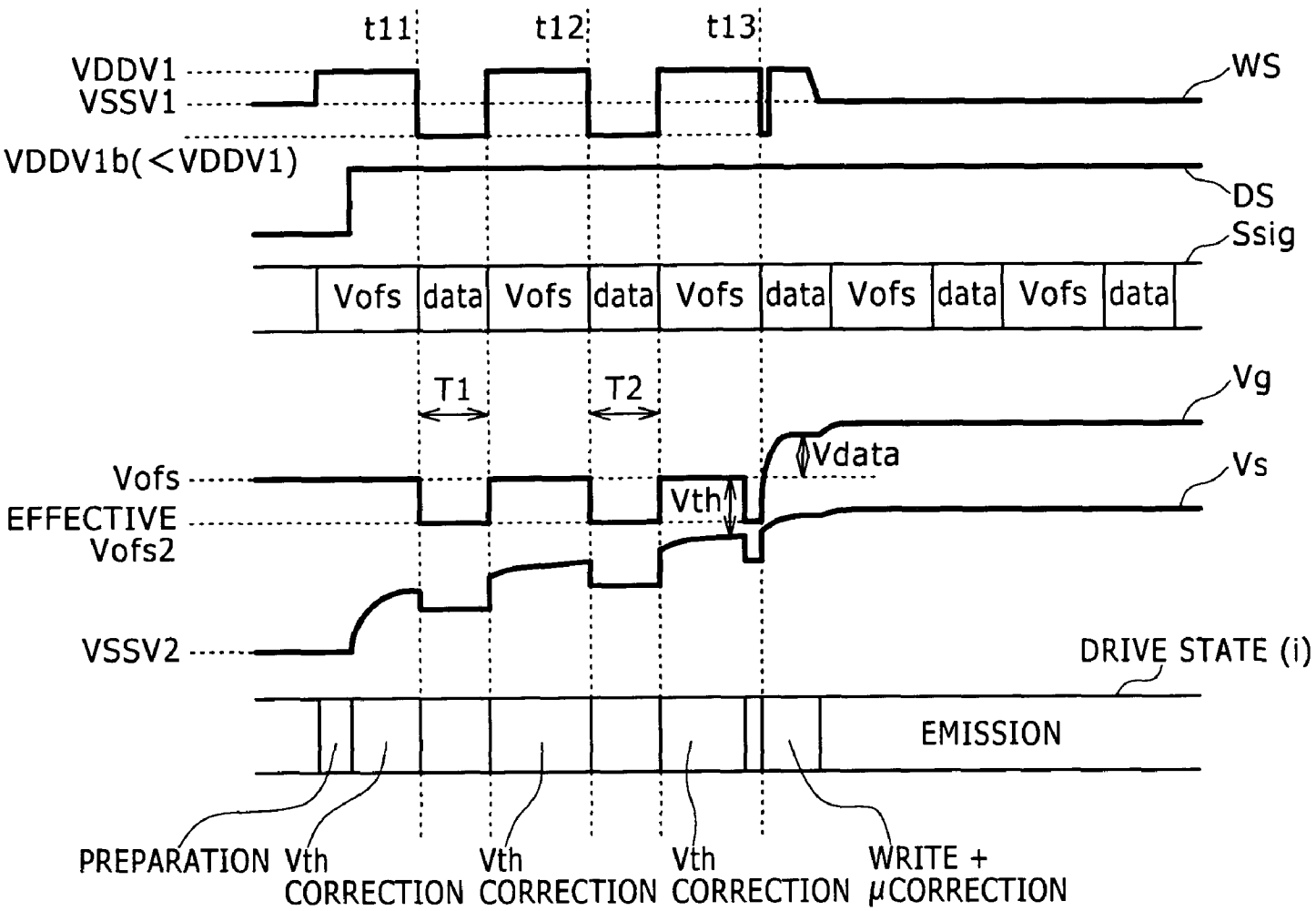
FIGS. 4A to 4F are a time chart explaining an operation of a pixel circuit which is applied to an image display device according to Embodiment 3 of the present invention.
Figure 13:
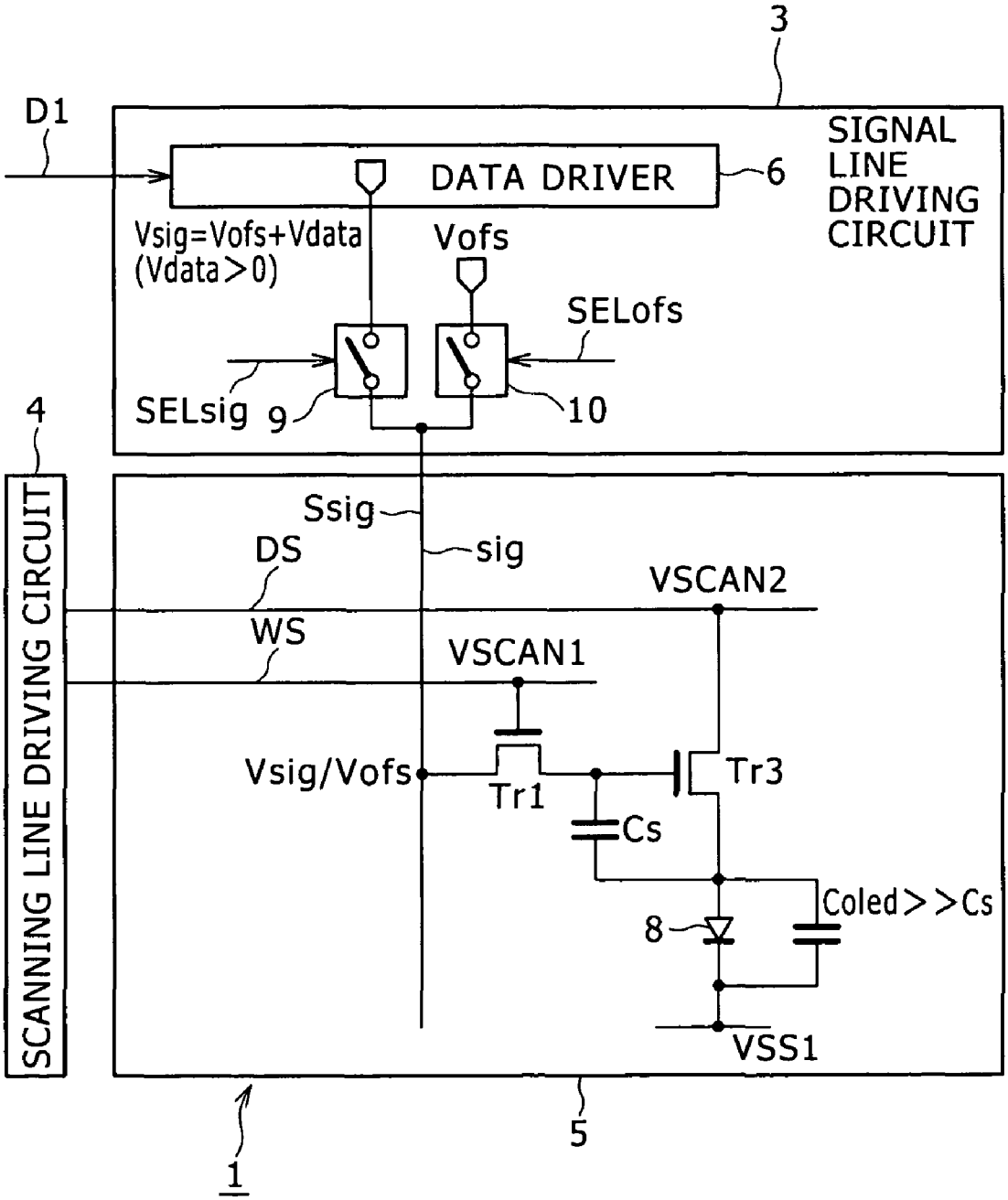
FIG. 13 is a circuit diagram, partly in block, showing a detailed configuration of a pixel circuit in the existing image display device shown in FIG. 12.
Figures 14A, 14B, 14C, 14D, 14E, 14F, 14G:
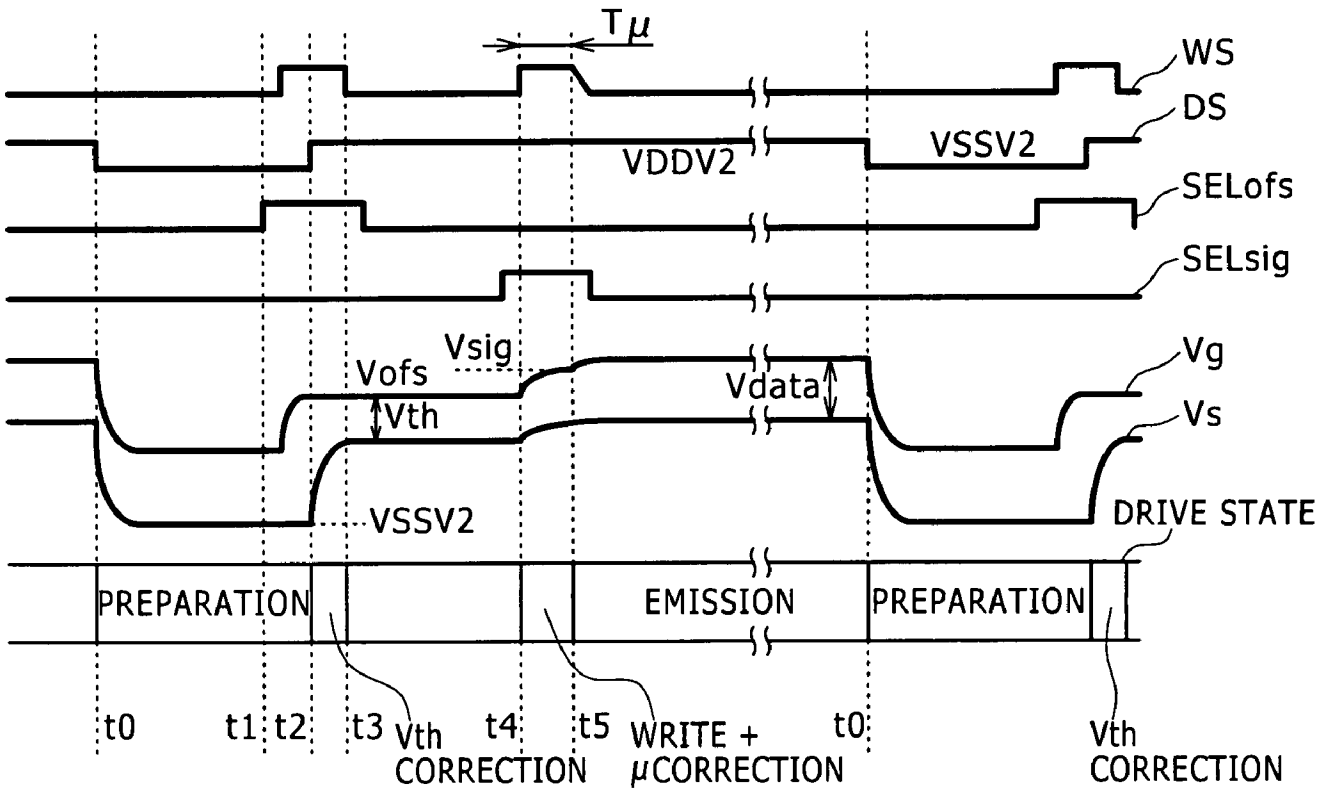
FIGS. 14A to 14G are a time chart explaining an operation of the pixel circuit shown in FIG. 13.
Figures 15A, 15B, 15C, 15D, 15E, 15F:
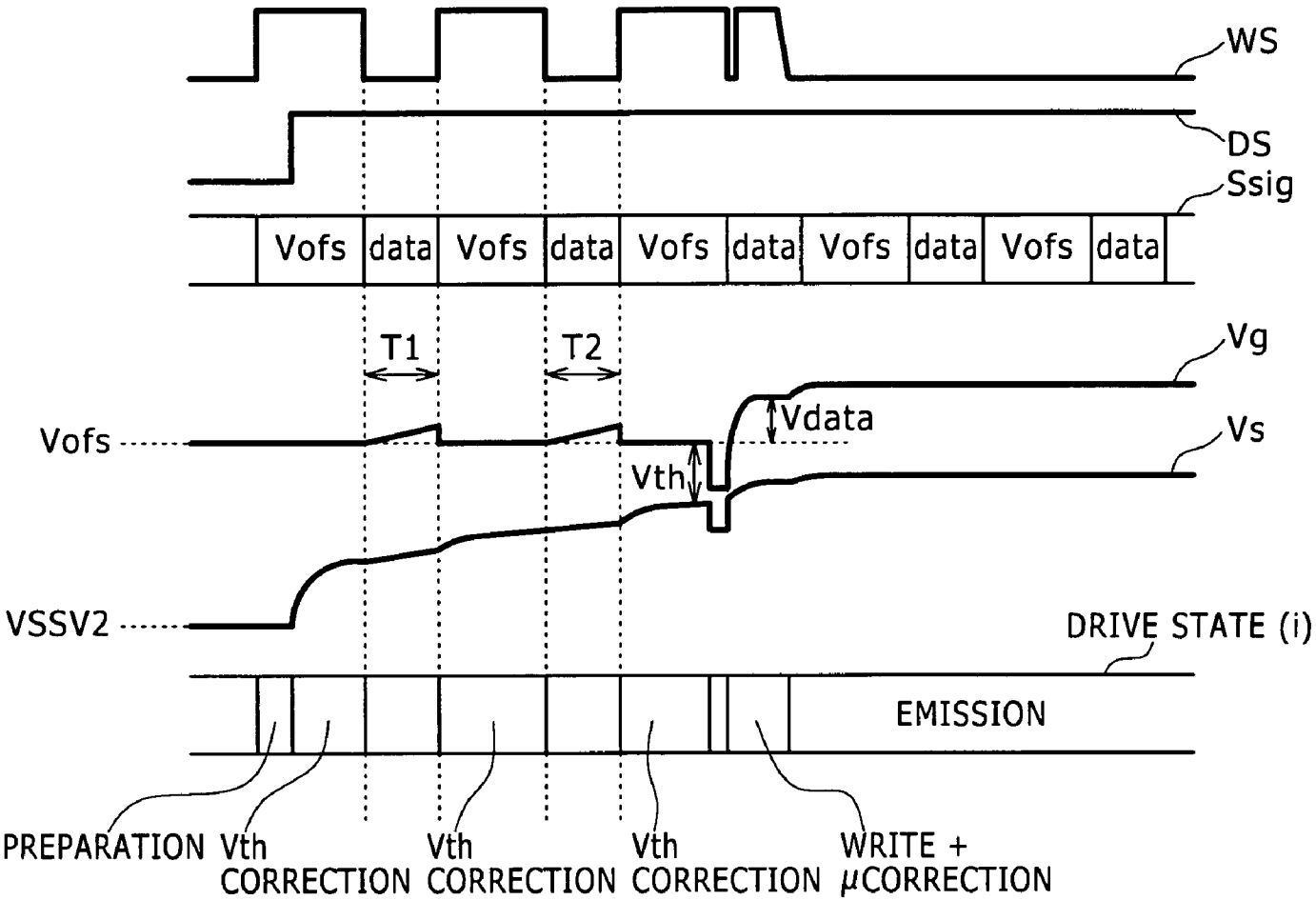
FIGS. 15A to 15F are a time chart explaining the case where processing for discharging electric charges corresponding to a voltage developed across terminals of a hold capacitor is executed multiple times.
Figures 16A, 16B, 16C, 16D, 16E, 16F:
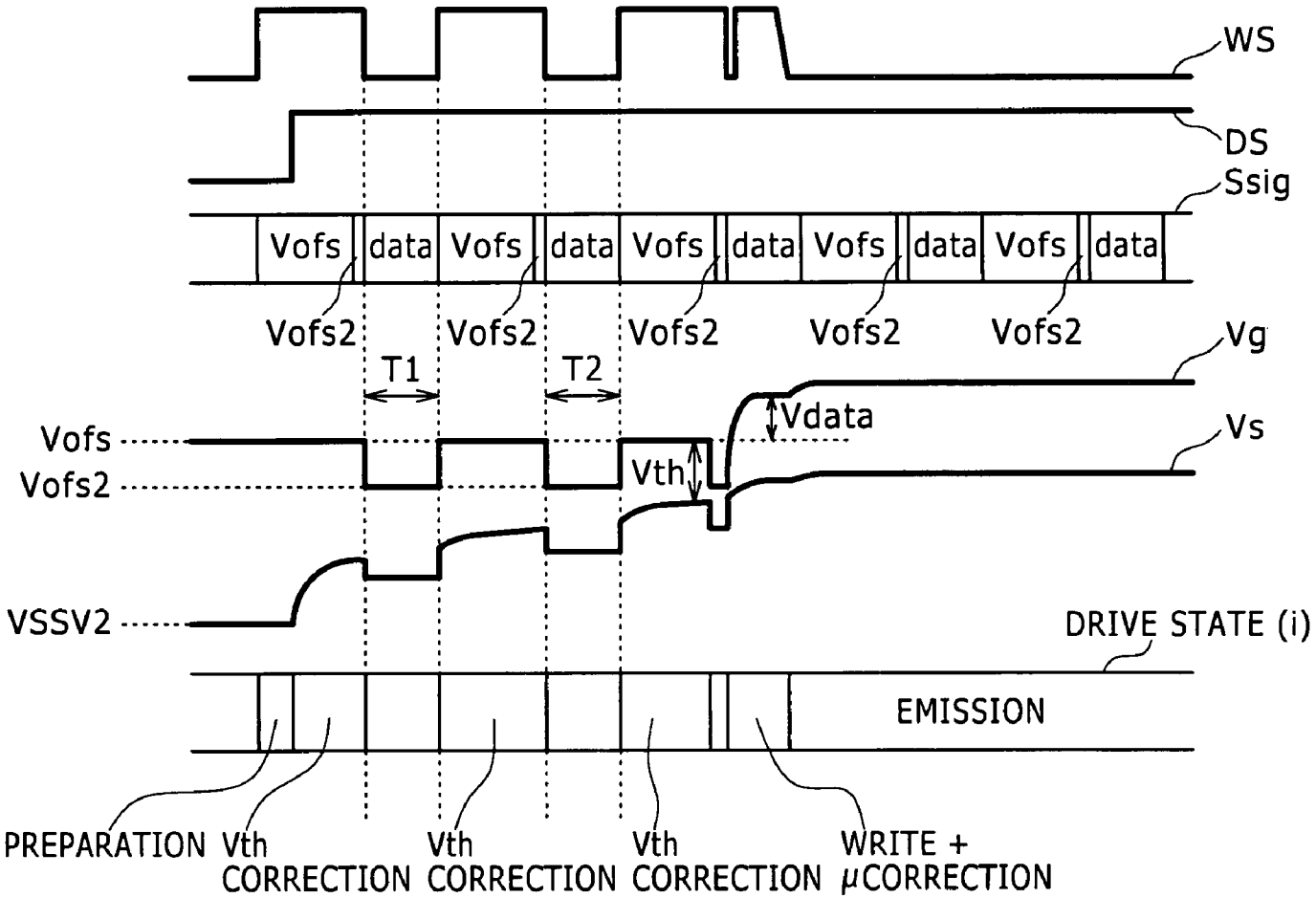
FIGS. 16A to 16F are a time chart explaining processing for a pause time period.
Figures 17A, 17B, 17C, 17D, 17E, 17F, 17G, 17H, 17I, 17J, 17K, 17L, 17M:
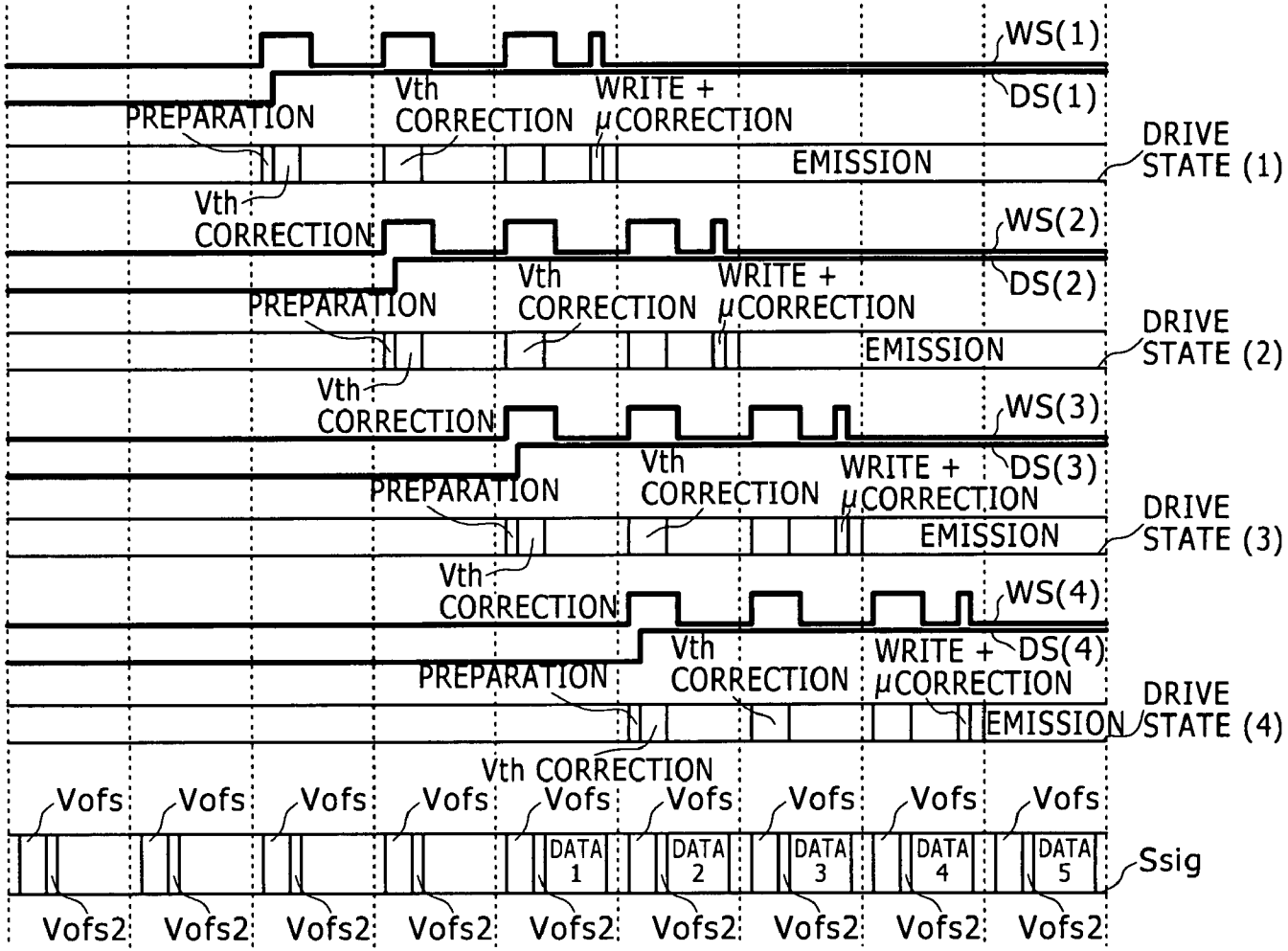
FIGS. 17A to 17M are a time chart explaining processing in a plurality of lines.

FIG. 2 is a circuit diagram, partly in block, showing a configuration of a pixel circuit which is applied to an image display device 21 according to Embodiment 1 of the present invention in contrast with the configuration of the pixel circuit in the existing image display device 1 shown in FIG. 13. The image display device 21 has the same configuration as that of the existing display device 1 described above except that a signal line driving circuit 23 and a scanning line driving circuit 24 are provided instead of providing the signal line driving circuit 3 and the scanning line driving circuit 4. Therefore, in the following description, portions corresponding to those shown in FIG. 13 are designated with the same reference numerals.

Figures 1A, 1B, 1C, 1D, 1E, 1F:
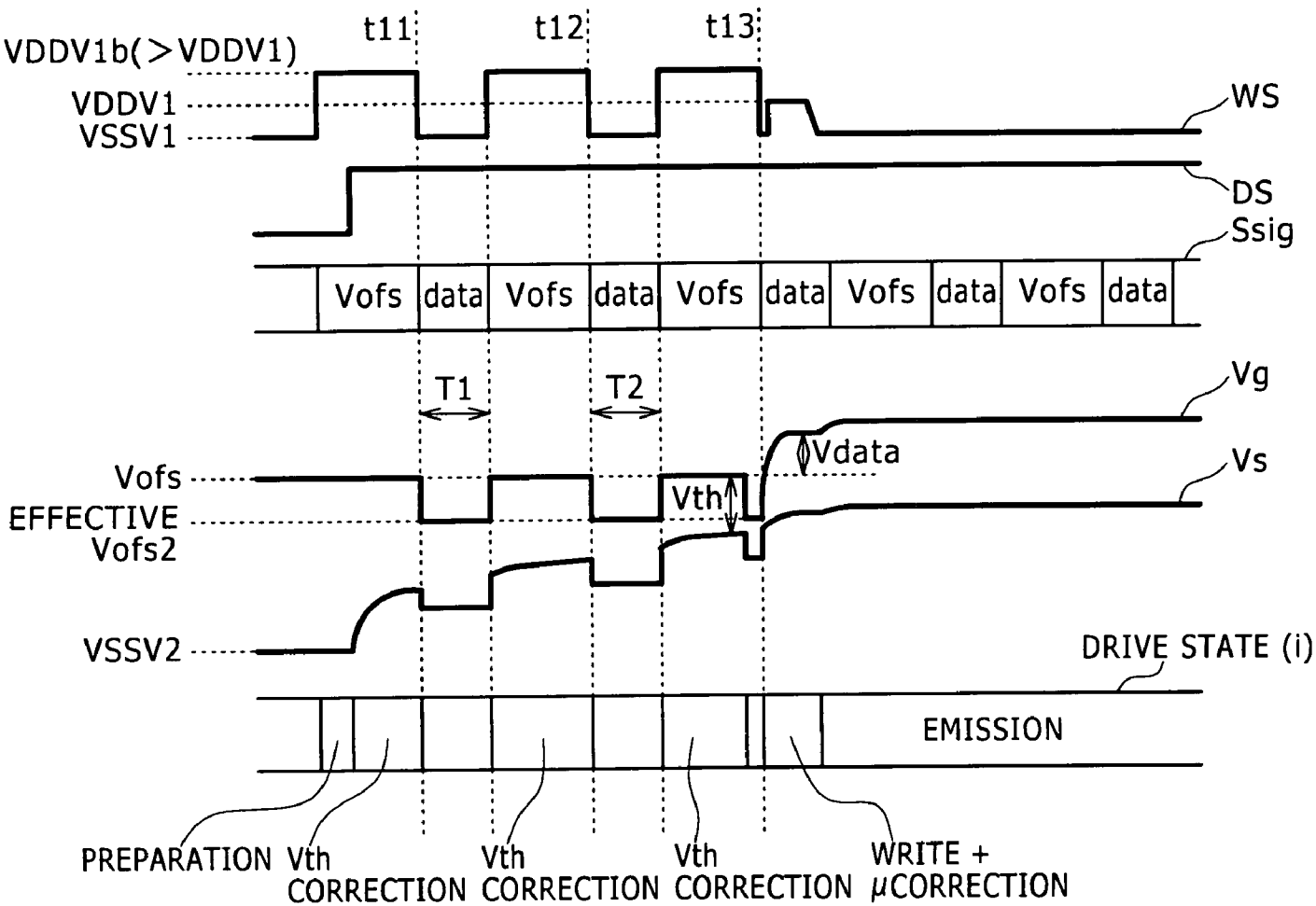
FIGS. 1A to 1F are a time chart explaining an operation of a pixel circuit which is applied to an image display device according to Embodiment 1 of the present invention.

Here, the signal line driving circuit 23, as shown in FIG. 1C, outputs alternately a voltage Vsig (Vdata+Vofs) for gradation setting, and a fixed voltage Vofs for threshold voltage to a signal line sig similarly to the case of the existing image display device 1 described above with reference to FIGS. 15A to 15F.

In the image display device 21, a gate voltage Vg of a drive transistor Tr3 is temporarily caused to drop for each of pause time periods T1 and T2 by utilizing running between wiring patterns formed on a substrate having a display portion 2 provided thereon, thereby reducing a gate-to-source voltage Vgs of the drive transistor Tr3. As a result, in the image display device 21, the setting is made in such a way that none of the gate voltage Vg and a source voltage Vs of the drive transistor Tr3 rises for each of the pause time periods T1 and T2. Thus, the processing for correcting the dispersion of the threshold voltages of the drive transistors Tr3 is prevented from being failed.

More specifically, in Embodiment 1, the gate voltage Vg of the drive transistor Tr3 is caused to temporarily rise for each of the pause time periods T1 and T2 by utilizing the running from a wiring pattern (a scanning line VSCAN1) for a write signal WS to a wiring pattern of a gate line of the drive transistor Tr3.

For this reason, in the image display device 21, the scanning line driving circuit 24 causes the write signal WS with a large amplitude at each of time points t11, t12 and t13 at each of which a time period ends for which a voltage developed across opposite terminals of a hold capacitor Cs is set at a threshold voltage Vth by carrying out discharge through the drive transistor Tr3. Specifically, in Embodiment 1, processing from the rising of the write signal WS made for the purpose of setting the voltage developed across the opposite terminals of the hold capacitor Cs at a voltage equal to or higher than the threshold voltage Vth of the drive transistor Tr3 to the falling of the write signal WS right before the voltage developed across the opposite terminals of the hold capacitor Cs is set at a voltage Vsig for gradation setting is executed with the large amplitude. As a result, the write signal WS is caused to rise with the large amplitude at each of the time points t11, t12 and t13.

For this reason, when the voltage developed across the opposite terminals of the hold capacitor Cs is set at a fixed voltage Vofs for threshold voltage correction, the scanning line driving circuit 24 causes the write signal WS to drop to a voltage VSSV1 after causing the write signal WS to rise from the voltage VSSV1 to a voltage VDDV1*b*. In addition, when the voltage developed across the opposite terminals of the hold capacitor Cs is set at the voltage Vsig for gradation setting, the scanning line driving circuit 24 causes the write signal WS to drop to the voltage VSSV1 after causing the write signal WS to rise from the voltage VSSV1 to a voltage VDDV1 (VDDV1<VDDV1*b*).

Here, when the voltage of the write signal WS is caused to drop with the large amplitude, in the pixel circuit 5, the gate voltage Vg of the drive transistor Tr3 largely drops due to a capacitance between the signal line sig and the gate line of the drive transistor Tr3. Here, it is noted that this capacitance contains therein a gate capacitance of the write transistor Tr1, a parasitic capacitance, and the like.

As a result, in Embodiment 1, the gate voltage Vg of the drive transistor Tr3 is set at the voltage Vofs2 for each of the pause time periods T1 and T2 by utilizing the running of the write signal WS caused by a capacitance between the scanning line VSCAN1 for the write signal WS, and the gate line of the drive transistor Tr3.

(2) Operation of Image Display Device 21 of Embodiment 1

Figure 12:
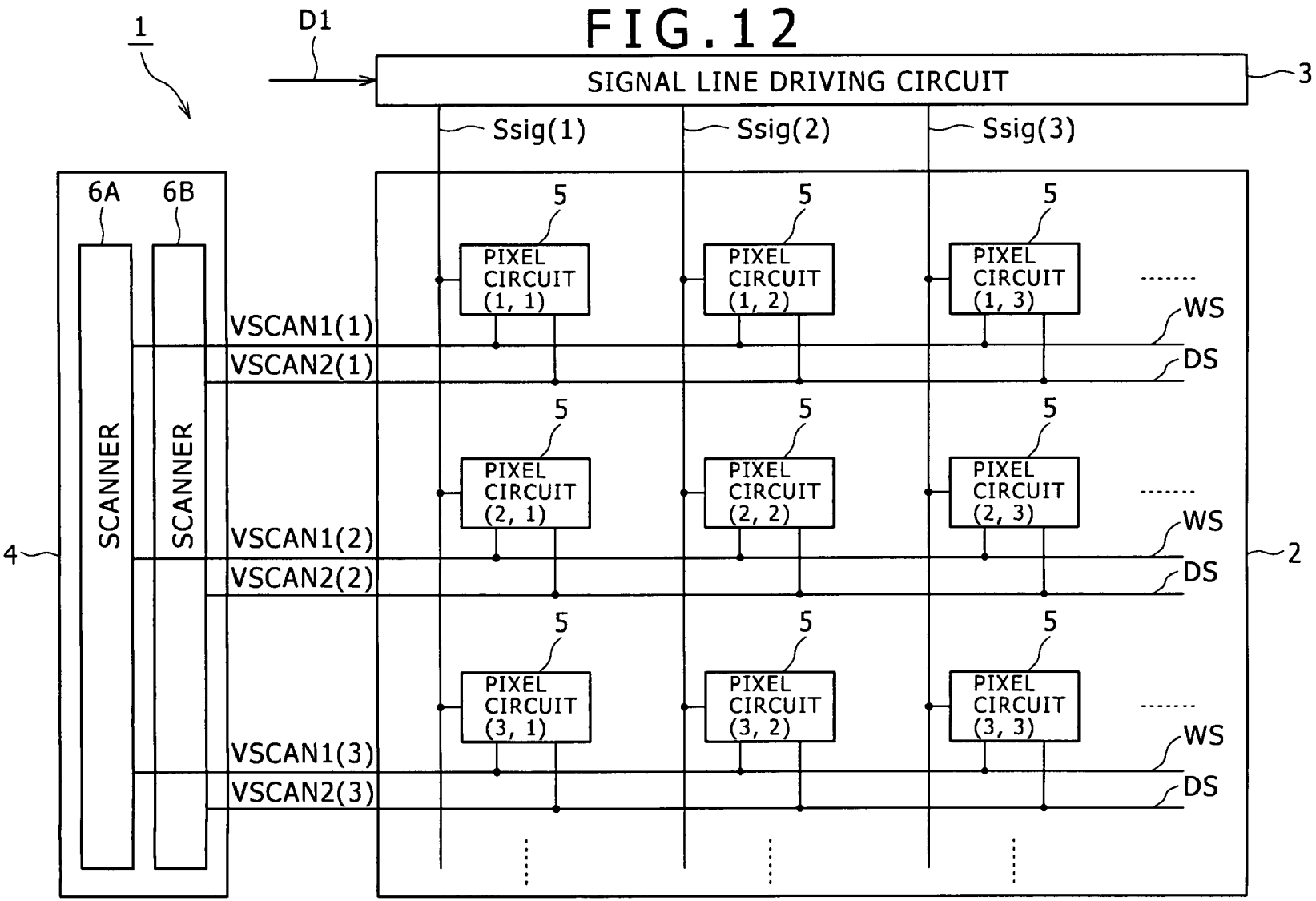
FIG. 12 is a block diagram showing an existing image display device.

With the configuration described above, in the image display device 21, after distributing the image data D1 successively inputted thereto among the signal lines sig of the display portion 2 (refer to FIG. 12), the signal line driving circuit 23 executes processing for digital-to-analog converting the image data D1 thus distributed. As a result, in the image display device 21, a gradation voltage Vdata used to instruct gradations for the pixels connected to corresponding one of the signal lines sig is generated every signal line sig. In the image display device 21, the gradation voltages Vdata is set in the pixel circuit 5 composing the display portion 2, for example, in a line-sequential manner by driving the display portion by the scanning line driving circuit 24. In addition, in the pixel circuits 5, organic EL elements 8 emit lights with emission luminances corresponding to the gradation voltages Vdata, respectively (refer to FIGS. 1A to 1F). As a result, with the image display device 21, an image corresponding to the gradation data D1 can be displayed on the display portion 2.

More specifically, in the pixel circuit 5, the organic EL element 8 is current-driven by the drive transistor Tr3 having a source follower circuit configuration. In the pixel circuit 5, a voltage at a gate side end of the hold capacitor Cs provided between a gate and a source of the drive transistor Tr3 is set at a voltage Vsig corresponding to the gradation voltage Vdata. As a result, in the image display device 21, the organic EL element 8 is caused to emit a light with the emission luminance corresponding to the gradation data D1, thereby displaying a desired image on the display portion 2.

However, the drive transistor Tr3 applied to each of those pixel circuits 5 has a disadvantage that the dispersion of the threshold voltages Vth is large. As a result, in the image display device 21, when the voltage at the gate side end of the hold capacitor Cs is merely set at the voltage Vsig corresponding to the gradation voltage Vdata, the emission luminances of the organic EL elements 8 disperse due to the dispersion of the threshold voltages Vth of the drive transistors Tr3. As a result, the image quality is deteriorated.

In order to cope with this situation, in the image display device 21, after a voltage at a side end of the organic EL element 8 of the hold capacitor Cs is caused to drop in advance, the gate voltage of the drive transistor Tr3 is set at the fixed voltage Vofs for threshold voltage correction through the write transistor Tr1 (refer to FIG. 2, and FIGS. 14A to 14G). As a result, the voltage developed across the opposite terminals of the hold capacitor Cs is set at a voltage equal to or higher than the threshold voltage Vth of the drive transistor Tr3. In addition, after that, the electric charges corresponding to the voltage developed across the opposite terminals of the hold capacitor Cs are discharged through the drive transistor Tr3. By executing the series of processing, in the image display device 21, the voltage developed across the opposite terminals of the hold capacitor Cs is set at the threshold voltage Vth of the drive transistor Tr3 in advance.

After that, in the image display device 21, the voltage Vsig for gradation setting obtained by adding the fixed voltage Vofs to the gradation voltage Vdata is set as the gate voltage of the drive transistor Tr3. As a result, in the image display device 21, it is possible to prevent the image quality from being deteriorated due to the dispersion of the threshold voltages Vth of the drive transistors Tr3 (refer to Expression (7)).

In addition, in a state in which the power source voltage is supplied to the drive transistor Tr3, the gate voltage of the drive transistor Tr3 is held at the voltage Vsig for gradation setting for a given time period Tμ, thereby making it possible to prevent the image quality from being deteriorated due to the dispersion of the mobilities μ of the drive transistors Tr3.

However, there is also estimated the case where it is difficult to allocate a sufficient time to the discharge of the electric charges corresponding to the voltage developed across the opposite terminals of the hold capacitor Cs through the drive transistor Tr3 due to the high resolution promotion or the like. In this case, in the image display device 21, the voltage developed across the opposite terminals of the hold capacitor Cs cannot be set at the threshold voltage Vth of the drive transistor Tr3 with high accuracy. As a result, there is encountered a problem that the dispersion of the threshold voltages Vth of the drive transistors Tr3 cannot be sufficiently corrected.

In this case, as shown in FIGS. 15A to 15F, it is expected that the discharge of the electric charges corresponding to the voltage developed across the opposite terminals of the hold capacitor Cs through the drive transistor Tr3 is carried out for the multiple time periods. In addition, as shown in FIGS. 16A to 16F, the fixed voltage Vofs2 lower than the fixed voltage Vofs is set between the voltage Vsig for gradation setting, and the fixed voltage Vofs for threshold voltage correction, thereby driving the signal line sig. Also, the gate voltage Vg of the drive transistor Tr3 is caused to temporarily drop by using the fixed voltage Vofs2, thereby making it possible to reliably set the voltage developed across the opposite terminals of the hold capacitor Cs at the threshold voltage Vth of the drive transistor Tr3.

That is to say, when the discharge of the electric charges corresponding to the voltage developed across the opposite terminals of the hold capacitor Cs through the drive transistor Tr3 is carried out for the multiple time periods, the sufficient time can be allocated to the discharge of the electric charges corresponding to the voltage developed across the opposite terminals of the hold capacitor Cs through the drive transistor Tr3. Therefore, even in the case of realizing the high resolution, it is possible to sufficiently correct the dispersion of the mobilities μ of the drive transistors Tr3.

However, when the signal line sig is merely driven by the repetition of the voltage Vsig for gradation setting, and the fixed voltage Vofs (refer to FIGS. 15A to 15F), and the discharge of the electric charges corresponding to the voltage developed across the opposite terminals of the hold capacitor Cs through the drive transistor Tr3 is merely carried out for the multiple time periods, the voltage developed across the opposite terminals of the hold capacitor Cs gradually rises for each of the pause time periods T1 and T2 for each of which the voltage of the signal line sig is set at the voltage Vsig (data) for gradation setting. As a result, when each of the pause time periods T1 and T2 ends, and the voltage at the signal line sig is set at the fixed voltage Vofs, the voltage developed across the opposite terminals of the hold capacitor Cs drops to a voltage equal to or lower than the threshold voltage Vth of the drive transistor Tr3 in some cases. In such cases, in the pixel circuit 5, the processing for correcting the dispersion of the threshold voltages Vth of the drive transistors Tr3 is failed.

However, when with the configuration explained with reference to FIGS. 16A to 16F, the gate voltage Vg of the drive transistor Tr3 is caused to temporarily drop by using the fixed voltage Vofs2 set in the signal line sig, it is possible to prevent the voltage developed across the opposite terminals of the hold capacitor Cs from rising for each of the pause time periods T1 and T2. This leads to that the threshold voltage correcting processing can be prevented from being failed, thereby preventing the deterioration of the image quality.

However, with the configuration explained with reference to FIGS. 16A to 16F, the voltage of the signal line sig needs to be switched from one of the voltages Vofs, Vofs2 and Vsig over to another one. This results in a disadvantage that the configuration of the signal line driving circuit 23 for driving the signal line sig becomes complicated. In addition, in the case of realizing of the high resolution, it is necessary to speed up the operating speed of the signal line driving circuit. As a result, there is a disadvantage that it is difficult to sufficiently ensure the switching speed. In addition, there is also a disadvantage that the power consumption increases all the more because the voltage of the signal line sig is set at the voltage Vofs2.

In order to cope with this situation, in Embodiment 1 (refer to FIGS. 1A to 1F, and FIG. 2), the gate-to-source voltage Vgs of the drive transistor Tr3 is temporarily reduced for each of the pause time periods T1 and T2 by utilizing the running between the wiring patterns formed on the substrate on which the display portion 2, the scanning line driving circuit 24, and the signal line driving circuit 23 are disposed. As a result, in Embodiment 1, for each of the pause time periods T1 and T2, each of the gate voltage Vg and the source voltage Vs of the drive transistor Tr3 is either prevented from rising, or reduced to a sufficiently extent in terms of the practical use. As a result, the processing for correcting the threshold voltage is prevented from being failed.

That is to say, when the gate-to-source voltage Vgs of the drive transistor Tr3 is reduced by utilizing the running between the wiring patterns in the manner described above, the voltage of the signal line sig does not need to be switched from one of the voltages Vofs, Vofs2 and Vsig to another one as in the case of the configuration explained with reference to FIGS. 16A to 16F. As a result, it is possible to simplify the configuration of the signal line driving circuit 23. In addition, the operating speed of the signal line driving circuit 23 does not need to be speeded up, thereby making it to possible to sufficiently cope with the high resolution promotion. In addition, the power consumption can be prevented from increasing.

As a result, in Embodiment 1, the dispersion of the threshold voltages Vth of the drive transistors Tr3 can be reliably corrected even when the discharge of the electric charges corresponding to the voltage developed across the terminals of the hold capacitor Cs through the drive transistor Tr3 is carried out for the multiple time periods so as to correct the dispersion of the threshold voltages Vth of the drive transistors Tr3 by discharging the electric charges corresponding to the voltage developed across the terminals of the hold capacitor Cs through the drive transistor Tr3. Therefore, it is possible to prevent the image quality from being deteriorated due to the dispersion of the threshold voltages Vth of the drive transistors Tr3.

Specifically, in Embodiment 1, the wiring pattern (the scanning line VSCAN1) for the write signal WS and the gate line of the drive transistor Tr3 are allocated to the wiring patterns concerned with the running. Also, for each of the pause time periods T1 and T2, the gate voltage Vg of the drive transistor Tr3 is set at the voltage Vofs2 by utilizing the running of the write signal WS into the gate line.

As a result, in Embodiment 1, for each of the pause time periods T1 and T2, the gate-to-source voltage Vgs of the drive transistor Tr3 can be temporarily reduced by the setting of the amplitude of the write signal WS. Thus, with the simple configuration, it is possible to reliably correct the dispersion of the threshold voltages Vth of the drive transistors Tr3.

More specifically, in Embodiment 1, the write signal WS is caused to drop with the large amplitude, which results in that the amplitude of the write signal WS is made large as compared with the case where the voltage developed across the opposite terminals of the hold capacitors Cs is set at the voltage Vsig for gradation setting, thereby turning OFF the write transistor Tr1. As a result, for each of the pause time periods T1 and T2, the gate-to-source voltage Vgs of the drive transistor Tr3 is temporarily reduced.

In addition, the amplitude of the write signal WS is made large only with respect to each of the pause time periods T1 and T2, which results in that it is possible to prevent the running of the write signal WS into the gate line during the setting of the voltage Vsig for gradation setting. Therefore, the voltage Vsig for gradation setting is properly set in the hold capacitor Cs, thereby making it possible to effectively avoid the deterioration of the image quality.

(3) Effects of Embodiment 1

According to the configuration described above, even when for the pause time period for which the discharge of the electric charges corresponding to the voltage developed across the opposite terminals of the hold capacitor is temporarily stopped, the gate-to-source voltage of the drive transistor is reduced by utilizing the running between the wiring patterns formed on the substrate, and thus the discharge of the electric charges corresponding to the voltage developed across the opposite terminals of the hold capacitor is carried out for the multiple time periods so as to correct the dispersion of the threshold voltages of the drive transistors by discharging the electric charges corresponding to the voltage developed across the opposite terminals of the hold capacitor through the drive transistor, it is possible to reliably correct the dispersion of the threshold voltages of the drive transistors.

In addition, the wiring pattern for the write signal, and the gate line of the drive transistor are applied to the wiring pattern concerned, which results in that even when the discharge of the electric charges corresponding to the voltage developed across the opposite terminals of the hold capacitor is carried out for the multiple time periods with the simple configuration adapted to merely manipulate the amplitude of the write signal, it is possible to reliably correct the dispersion of the threshold voltages of the drive transistors.

More specifically, it is possible to reliably correct the dispersion of the threshold voltages of the drive transistors even when the amplitude of the write signal is made large as compared with the case where the voltage developed across the opposite terminals of the hold capacitor is set at the voltage for gradation setting, thereby turning OFF the write transistor, and thus with the simple configuration adapted to merely set the amplitude of the write signal, the discharge of the electric charges corresponding to the voltage developed across the opposite terminals of the hold capacitor is carried out for the multiple time periods. In addition, it is possible to prevent the image quality from being deteriorated due to the running.

In addition, the voltage of the write signal is caused to rise to the high voltage to obtain the large amplitude as compared with the case where the voltage developed across the opposite terminals of the hold capacitor is set at the voltage for gradation setting, which results in that specifically, the amplitude of the write signal can be made large with respect to the pause time period.

Embodiment 2

FIGS. 3A to 3F are a time chart explaining an operation of a pixel circuit in an image display device according to Embodiment 2 of the present invention in contrast with the case of the operation of the pixel circuit explained with reference to FIGS. 1A to 1F. The image display device of Embodiment 2 has the same configuration as that of the image display device 21 of Embodiment 1 except that a configuration of a scanner 6A (refer to FIG. 12) concerned with generation of a write signal WS in a scanning line driving circuit is different from that of the scanner 6A in Embodiment 1. In addition, the image display device of Embodiment 2 has the same configuration as that of the image display device 21 of Embodiment 1 except that with regard to the scanner 6A, after being caused to rise with the large amplitude only with leading one cycle, the write signal WS is caused to drop with the large amplitude.

That is to say, when the voltage developed across the opposite terminals of the hold capacitor Cs is set at the threshold voltage Vth of the drive transistor Tr3 by the discharge of the electric charges corresponding to the voltage developed across the opposite terminals of the hold capacitor Cs through the drive transistor Tr3, the voltage developed across the opposite terminals of the hold capacitor Cs exponentially changes to gradually approach the threshold voltage Vth of the drive transistor Tr3.

Therefore, in the example explained with reference to FIGS. 15A to 15F, the gate-to-source voltage Vgs of the drive transistor Tr3 becomes largest at a time point right before start of the leading pause time period T1 of the pause time periods T1 and T2 for each of which the discharge of the electric charges corresponding to the voltage developed across the opposite terminals of the hold capacitor Cs through the drive transistor Tr3 is stopped. Therefore, in the example explained with reference to FIGS. 15A to 15F, the rising speed of each of the gate voltage Vg and the source voltage Vs of the drive transistor Tr3 becomes highest for the pause time period T1.

Therefore, the processing for correcting the threshold voltage Vth is failed for the leading pause time period T1.

In order to cope with this situation, in Embodiment 2, the write signal WS is caused to rise with the large amplitude only for the leading pause time period T1, thereby preventing the processing for correcting the threshold voltage Vth from being failed.

According to Embodiment 2, after the voltage developed across the opposite terminals of the hold capacitor Cs is set at the voltage equal to or higher than the threshold voltage Vth, the amplitude of the write signal WS is made large at the timing at which the write transistor Tr1 is first turned OFF, thereby further reducing the power consumption as compared with the case of the configuration in Embodiment 1. Thus, it is possible to obtain the same effects as those in Embodiment 1. In addition, when the fixed voltage Vofs is set and the threshold voltage correcting processing finally ends, it is possible to prevent the running of the write signal WS into the gate line. Therefore, it is possible to properly correct the dispersion of the threshold voltages Vth of the drive transistors Tr3.

Embodiment 3

FIGS. 4A to 4F are a time chart explaining an operation of a pixel circuit in an image display device according to Embodiment 3 of the present invention in contrast with the case of the operation of the pixel circuit explained with reference to FIGS. 1A to 1F. The image display device of Embodiment 3 has the same configuration as that of the image display device 21 of Embodiment 1 except that a configuration of a scanner 6A (refer to FIG. 12) concerned with generation of a write signal WS in a scanning line driving circuit is different from that of the scanner 6A in Embodiment 1.

In addition, in Embodiment 3, with regard to the scanner 6A, for a time period for which the write signal is caused to drop with the large amplitude by switching from one of the voltages VSSV1 and VSSV1*b* to the other in the phase of the rising of the write signal WS, thereby setting the voltage of the signal line at the voltage for gradation setting, the gate voltage of the drive transistor is caused to drop.

That is to say, in Embodiment 3, after being caused to rise from the voltage VSSV1 to the voltage VDDV1, the write signal WS is caused to drop from the voltage VDDV1 to the voltage VSSV1*b* lower than the voltage VSSV1, thereby causing the write signal WS to drop with the large amplitude. Subsequently, an operation for causing the write signal WS to drop to the voltage VDDV1*b* after being caused to rise from the voltage VSSV1*b* to the voltage VDDV1 is repetitively carried out, thereby causing the write signal WS to drop with the large amplitude in this case as well. Subsequently, after being caused to rise from the voltage VSSV1*b* to the voltage VDDV1, the write signal WS is caused to drop to the voltage VDDV1, thereby preventing the running of the write signal WS when the voltage Vsig for gradation setting is set in the hold capacitor Cs.

It is noted that the write signal WS may also be caused to drop with the large amplitude only for the leading time period by switching one of the voltages over to the other similarly to the case of Embodiment 2.

Even when the write signal WS is caused to drop to the low voltage to have the large amplitude as in the case of Embodiment 3 as compared with the case where the voltage developed across the opposite terminals of the hold capacitor Cs is set at the voltage for gradation setting, it is possible to obtain the same effects as those in Embodiment 1 or Embodiment 2.

Embodiment 4

Figure 5:
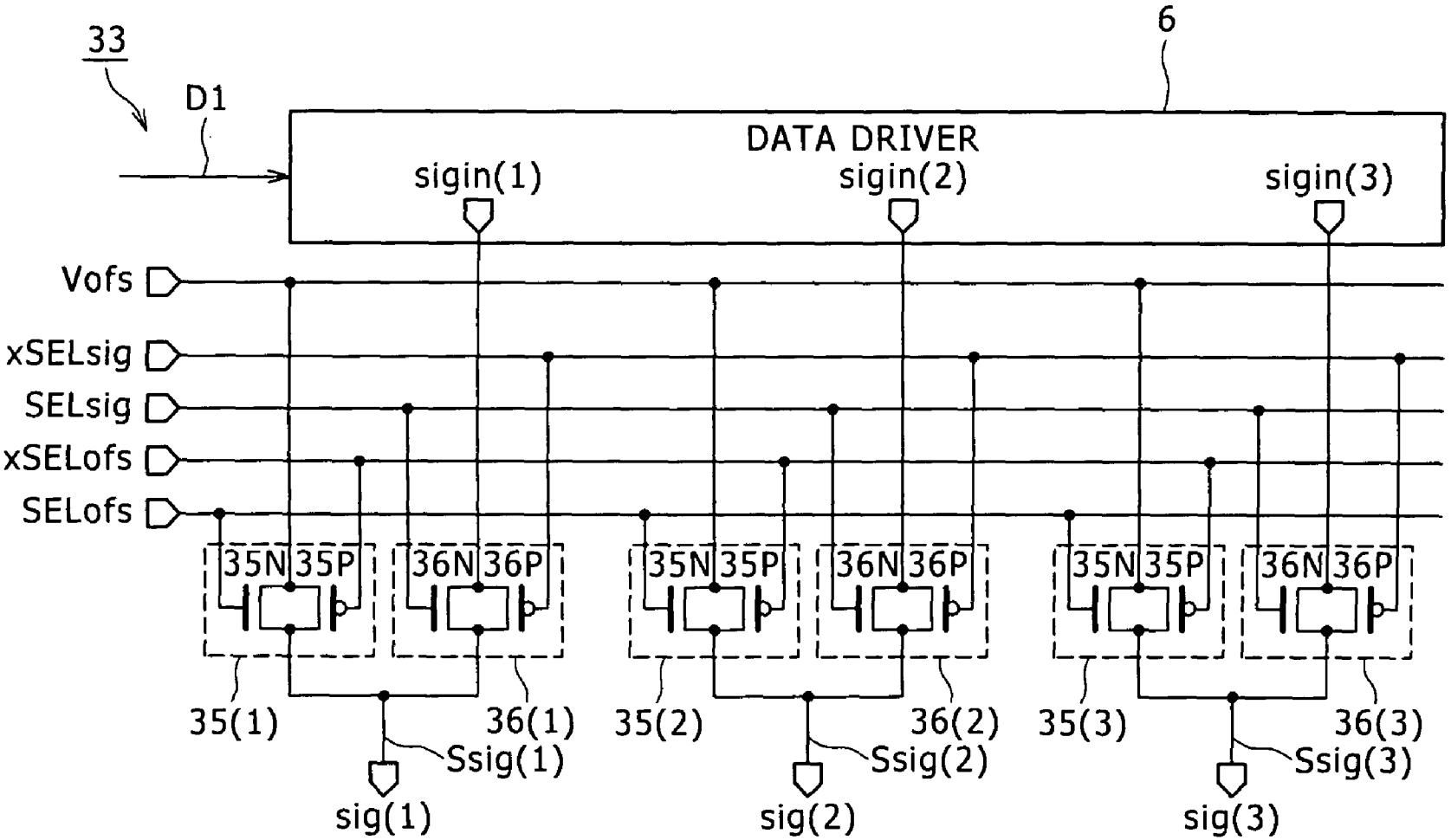
FIG. 5 is a circuit diagram, partly in block, showing a configuration of a signal line driving circuit which is applied to an image display device according to Embodiment 4 of the present invention.

FIG. 5 is a circuit diagram, partly in block, showing a configuration of a signal line driving circuit which is applied to an image display device according to Embodiment 4 of the present invention. The image display device of Embodiment 4 has the same configuration as that of the existing image display device explained with reference to FIGS. 15A to 15F except that the signal line driving circuit 33 is applied thereto.

In the signal line driving circuit 33, a data driver 6 successively latches image data D1 successively inputted thereto, and distributes the image data D1 among signal lines sig (1), sig (2), sig (3), . . . . In addition, the data driver 6 executes processing for digital-to-analog converting the image data D1 thus distributed, and outputs drive signals sigin (1), sigin (2), sigin (3), . . . for the signal lines sig (1), sig (2), sig (3), . . . . It is noted that these drive signals sigin (1), sigin (2), sigin (3), . . . obtained through continuity of the voltages Vsig for gradation setting for the signal lines sig described above.

The signal line driving circuit 33 outputs the drive signals sigin (1), sigin (2), sigin (3), . . . to the corresponding signal lines sig (1), sig (2), sig (3), . . . through switch circuits 36(1), 36(2), 36(3), . . . , respectively. In addition, the signal line driving circuit 33 outputs the fixed voltage Vofs for threshold voltage correction to each of the signal lines sig (1), sig (2), sig (3), . . . through switch circuits 35(1), 35(2), 35(3), . . . corresponding to the switch circuits 36(1), 36(2), 36(3), . . . , respectively.

Figures 6A, 6B, 6C, 6D, 6E, 6F:
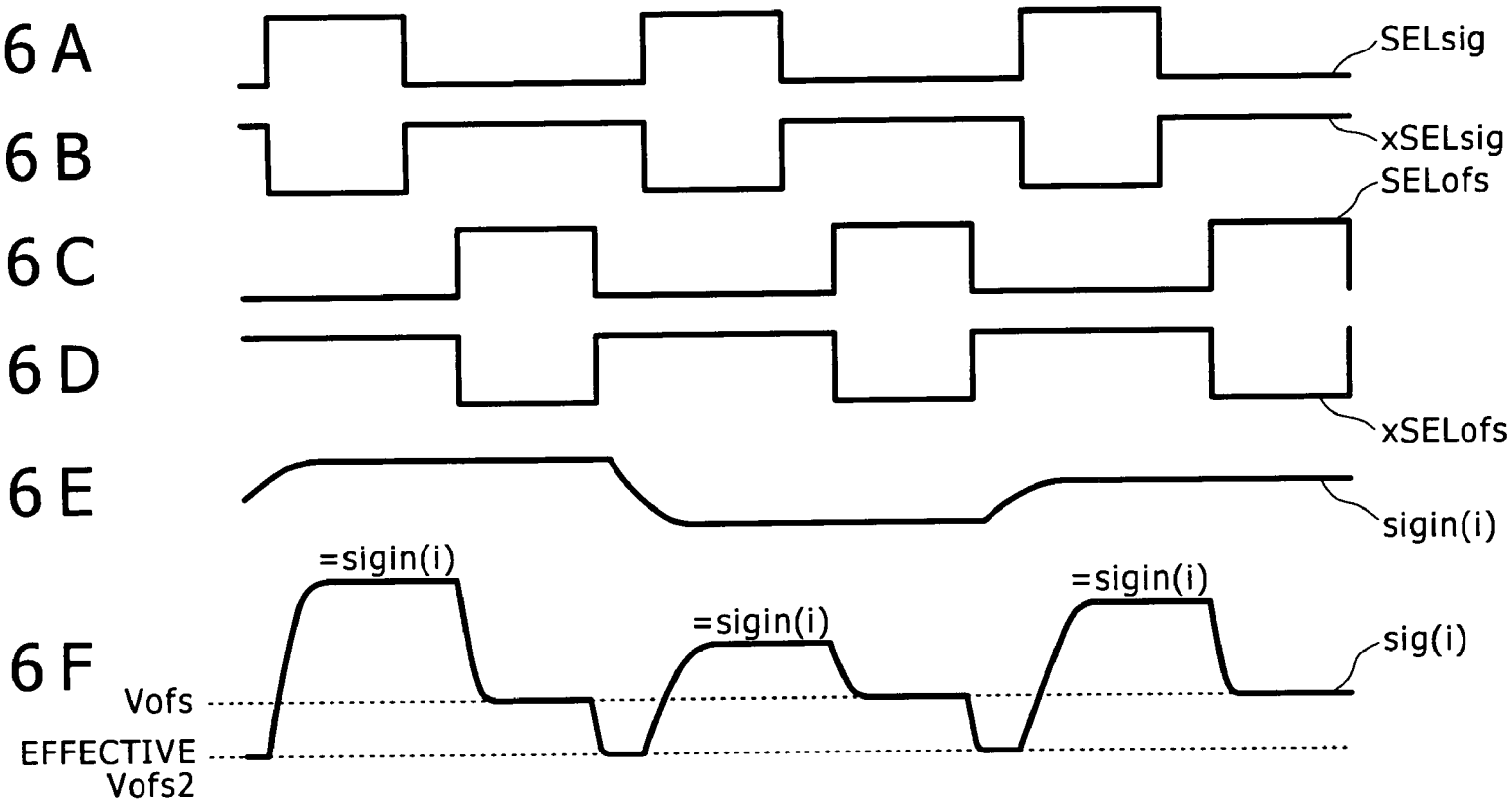
FIGS. 6A to 6F are a time chart explaining an operation of the signal line driving circuit shown in FIG. 5 which is applied to the image display device of Embodiment 4.
Figures 7A, 7B, 7C, 7D, 7E, 7F:
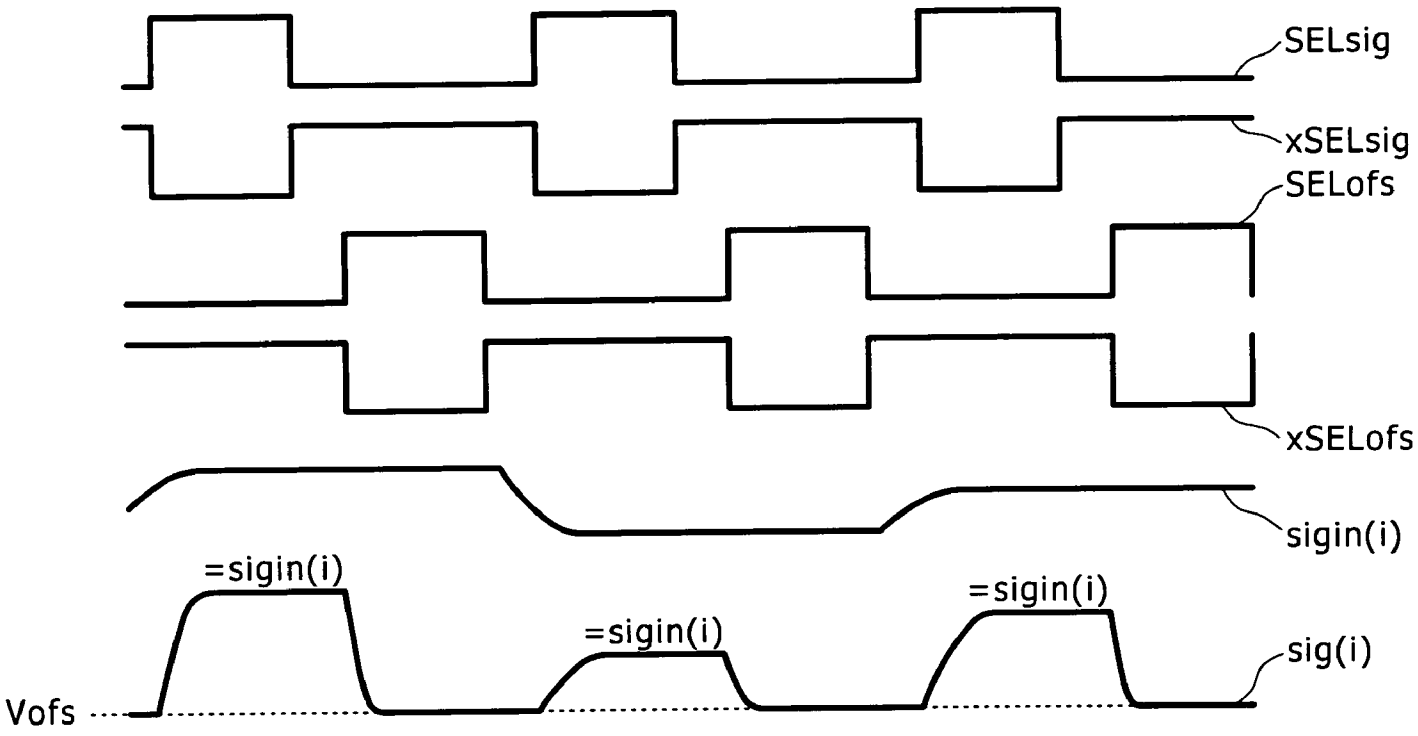
FIGS. 7A to 7F are a time chart explaining an operation of a signal line driving circuit shown in FIG. 5 which is applied to an existing image display device in contrast with the case shown in FIGS. 6A to 6F.

Here, each of the switch circuits 36(1), 36(2), 36(3), . . . is composed of a MOS switch circuit which operates so as to be turned ON/OFF in accordance with a control signal SELsig, and an inverted signal xSELsig obtained by inverting the control signal SELsig. That is to say, each of the switch circuits 36(1), 36(2), 36(3), . . . is provided with an N-channel transistor 36N and a P-channel transistor 36P. Also, a drain of the N-channel transistor 36N, and a source of the P-channel transistor 36P are connected to each other in each of the switch circuits 36(1), 36(2), 36(3), . . . . Also, in each of the switch circuits 36(1), 36(2), 36(3), . . . , the control signal SELsig, and the inverted signal xSELsig are inputted to gates of the N-channel transistor 36N and the P-channel transistor 36P, respectively. Also, as shown in FIGS. 6A, 6B and 6F, the switch circuits 36(1), 36(2), 36(3), . . . output the drive signals sigin (1), sigin (2), sigin (3), . . . to the corresponding signal lines sig (1), sig (2), sig (3), . . . , respectively, in accordance with the control operation using the control signal SELsig and the inverted signal xSELsig.

Similarly, each of the switch circuits 35(1), 35(2), 35(3), . . . is composed of a MOS switch circuit which operates so as to be turned ON/OFF in accordance with a control signal SELofs, and an inverted signal xSELofs obtained by inverting the control signal SELofs. That is to say, each of the switch circuits 35(1), 35(2), 35(3), . . . is provided with an N-channel transistor 35N and a P-channel transistor 35P. Also, a drain of the N-channel transistor 35N, and a source of the P-channel transistor 35P are connected to each other in each of the switch circuits 35(1), 35(2), 35(3), . . . . Also, in each of the switch circuits 35(1), 35(2), 35(3), . . . , the control signal SELofs, and the inverted signal xSELofs are inputted to gates of the N-channel transistor 35N and the P-channel transistor 35P, respectively. Also, as shown in FIGS. 6C, 6D and 6F, the switch circuits 35(1), 35(2), 35(3), . . . output the fixed voltages Vofs to the corresponding signal lines sig (1), sig (2), sig (3), . . . , respectively, in accordance with the control operation using the control signal SELofs and the inverted signal xSELofs.

The signal line driving circuit 33 is formed in such a way that in each of the switches 35(1), 35(2), 35(3), . . . each concerned with the fixed voltage Vofs, a gate size (area) of the N-channel transistor 35N is larger than that of the P-channel transistor 35P. As a result, when stopping the operation for outputting the write signal Vofs in accordance with the control signal SELofs and the inverted signal xSELofs, the signal driving circuit 33 sets the voltage of the signal line sig at a voltage Vofs2 lower than the fixed potential Vofs (refer to FIG. 6F). As a result, in Embodiment 4, the voltage of the signal line sig is set at the voltage Vofs2 by utilizing the running between the wiring pattern for the control signal SELofs in accordance with which the operation for outputting the fixed voltage Vofs is controlled, and the wiring pattern of the signal line sig. Thus, the gate-to-source voltage Vgs of the drive transistor Tr3 is reduced for each of the pause time periods T1 and T2.

FIGS. 7A to 7F show a time chart when the N-channel transistor 35N and the P-channel transistor 35P are formed to have the same gate size (area) in contrast with the case explained with reference to FIGS. 6A to 6F.

Here, a ratio of the gate size (area) of the N-channel transistor 35N to the gate size (area) of the P-channel transistor 35P is expressed by size(35N/35P). Also, a ratio of the gate size (area) of the N-channel transistor 36N on the side of the voltage Vsig for gradation setting to the gate size (area) of the P-channel transistor 36P on the side of the voltage Vsig for gradation setting is expressed by size(36N/36P). In this case, a relationship of size(35N/35P)>size(36N/36P) may be adopted instead of forming the N-channel transistor 35N to have a larger gate size (area) than that of the P-channel transistor 35P. In this case as well, the voltage of the signal line sig can be set at the voltage Vofs2 by utilizing the running between the wiring pattern for the control signal SELofs in accordance with which the operation for outputting the fixed voltage Vofs is controlled, and the wiring pattern of the signal line sig.

In addition, each of the switch circuits 35(1), 35(2), 35(3), . . . , and each of the switch circuits 36(1), 36(2), 36(3), . . . may be composed of only the N-channel transistors 35N and 36N, respectively. In this case, the gate size (area) of each of the N-channel transistors 35N on the sides of the switch circuits 35(1), 35(2), 35(3), . . . is made larger than that of each of the N-channel transistors 36N on the sides of the switch circuits 36(1), 36(2), 36(3), . . . . As a result, the voltage of the signal line sig can be set at the voltage Vofs similarly to the case previously described.

According to Embodiment 4, it is possible to obtain the same effects as those in any of Embodiments 1 to 3 even when the wiring pattern for the control signal in accordance with the operation for outputting the fixed voltage to the signal line is controlled, and the wiring pattern of the signal line are applied to the wiring pattern concerned with the running so as to reduce the gate-to-source voltage of the drive transistor by utilizing the running between the wiring patterns formed on the substrate.

More specifically, it is possible to obtain the same effects as those in each of Embodiments 1 to 3 described above even when the gate-to-source voltage of the drive transistor is reduced for the pause time period in accordance with the setting of the ratio of the gate size (area) of the transistor for controlling the outputs of the fixed voltage and/or the voltage for gradation setting to the gate size (area).

Embodiment 5

FIGS. 8A to 8F are a time chart explaining an operation of an image display device according to Embodiment 5 of the present invention in contrast with the case of the operation of the signal line driving circuit in the image display device explained with reference to FIGS. 7A to 7F. The image display device of Embodiment 5 has the same configuration as that of the image display device of Embodiment 4 except that in the image display device of Embodiment 4, the N-channel transistor 35N and the P-channel transistor 35P, and the N-channel transistor 36N and the P-channel transistor 36P of the signal line driving circuit are formed to have the same sizes, respectively, and except that the control signals concerned with the N-channel transistor 35N and the P-channel transistor 35P, and the N-channel transistor 36N and the P-channel transistor 36P are different from each other.

Figures 8A, 8B, 8C, 8D, 8E, 8F:
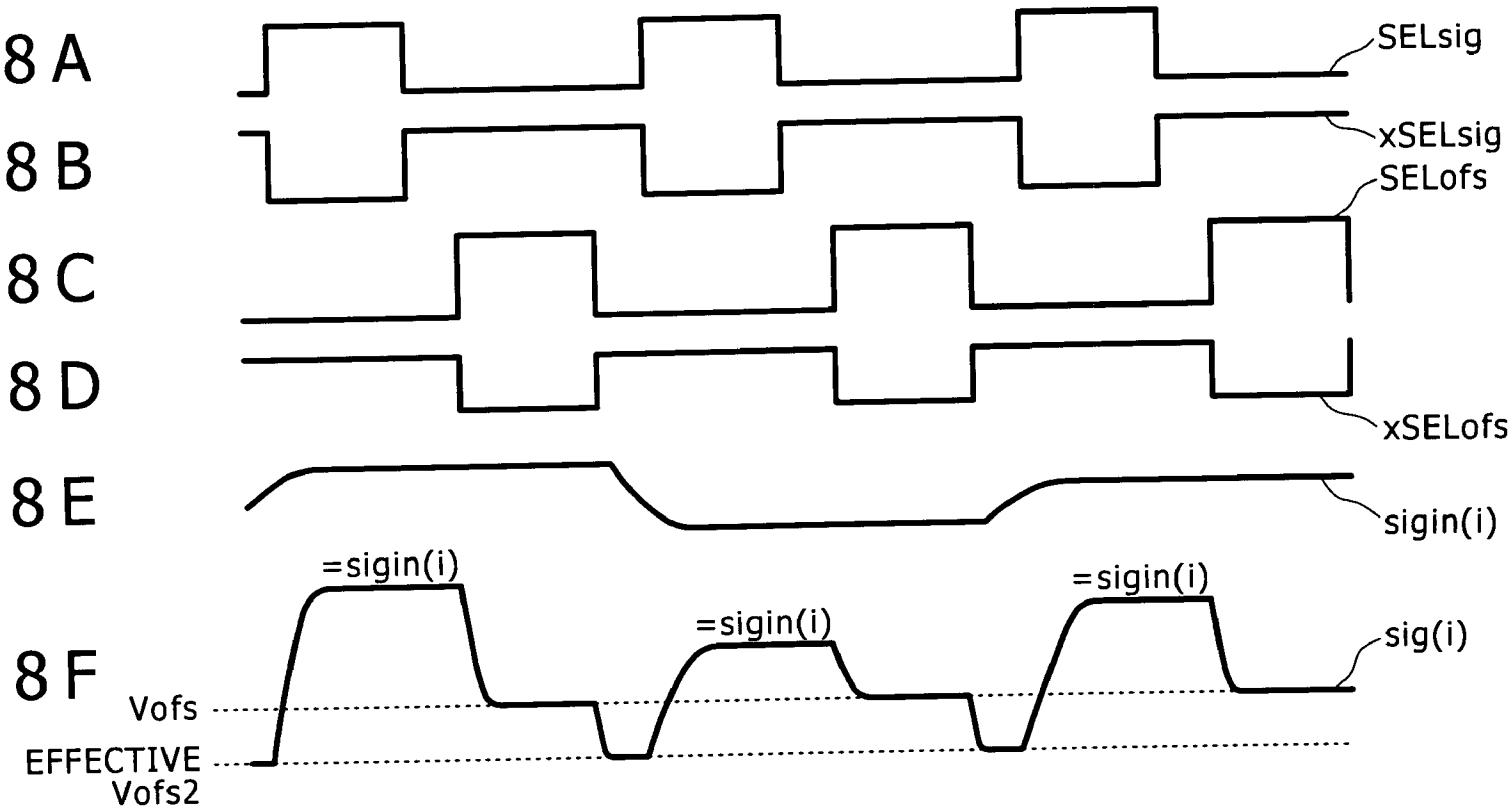
FIGS. 8A to 8F are a time chart explaining an operation a signal line driving circuit which is applied to an image display device according to Embodiment 5 of the present invention.

In Embodiment 5, the amplitude of the control signal SELofs in accordance with which the N-channel transistor 35N is turned ON/OFF is made larger than that of the control signal xSELofs in accordance with which the P-channel transistor 35P is turned ON/OFF (refer to FIGS. 8C and 8D). As a result, in Embodiment 5, the voltage of the signal line sig is set at the voltage Vofs2, and thus the gate-to-source voltage Vgs of the drive transistor Tr3 is reduced for each of the pause time periods T1 and T2.

Here, a ratio of the amplitude of the N-channel transistor 35N on the fixed voltage side to the amplitude of the P-channel transistor 35P on the fixed voltage side is expressed by V(35N/35P). Also, a ratio of the amplitude of the N-channel transistor 36N on the side of the voltage Vsig for gradation setting to the amplitude of the P-channel transistor 36P on the side of the voltage Vsig for gradation setting is expressed as V(36N/36P) In this case, a relationship of V(35N/35P)>V(36N/36P) may be adopted instead of making the amplitude of the control signal SELofs for the N-channel transistor 35N larger than that of the control signal xSELofs for the P-channel transistor 35P. In this case as well, the voltage of the signal line sig can be set at the voltage Vofs2 by utilizing the running between the wiring pattern for the control signal SELofs in accordance with which the operation for outputting the fixed voltage Vofs is controlled, and the wiring pattern of the signal line sig.

In addition, each of the switch circuits 35(1), 35(2), 35(3), . . . , and each of the switch circuits 36(1), 36(2), 36(3), . . . may be composed of only the N-channel transistors 35N and 36N, respectively. In this case, the amplitude of each of the N-channel transistors 35N on the sides of the switch circuits 35(1), 35(2), 35(3), . . . is made larger than that of each of the N-channel transistors 36N on the sides of the switch circuits 36(1), 36(2), 36(3), . . . . As a result, the voltage of the signal line sig can be set at the voltage Vofs similarly to the case previously described.

It is possible to obtain the same effects as those in each of Embodiments 1 to 4 described above even when the gate-to-source voltage of the drive transistor is reduced for the pause time period by utilizing the running from the wiring pattern for the control signal in accordance with which the operation for outputting the fixed voltage and/or the voltage for gradation setting to the signal line is controlled to the wiring pattern of the signal line as in the case of Embodiment 5.

More specifically, it is possible to obtain the same effects as those in each of Embodiments 1 to 4 described above even when the gate-to-source voltage of the drive transistor is reduced in accordance with the setting of the ratio of the amplitude of the control signal to the amplitude.

Embodiment 6

Figure 9:
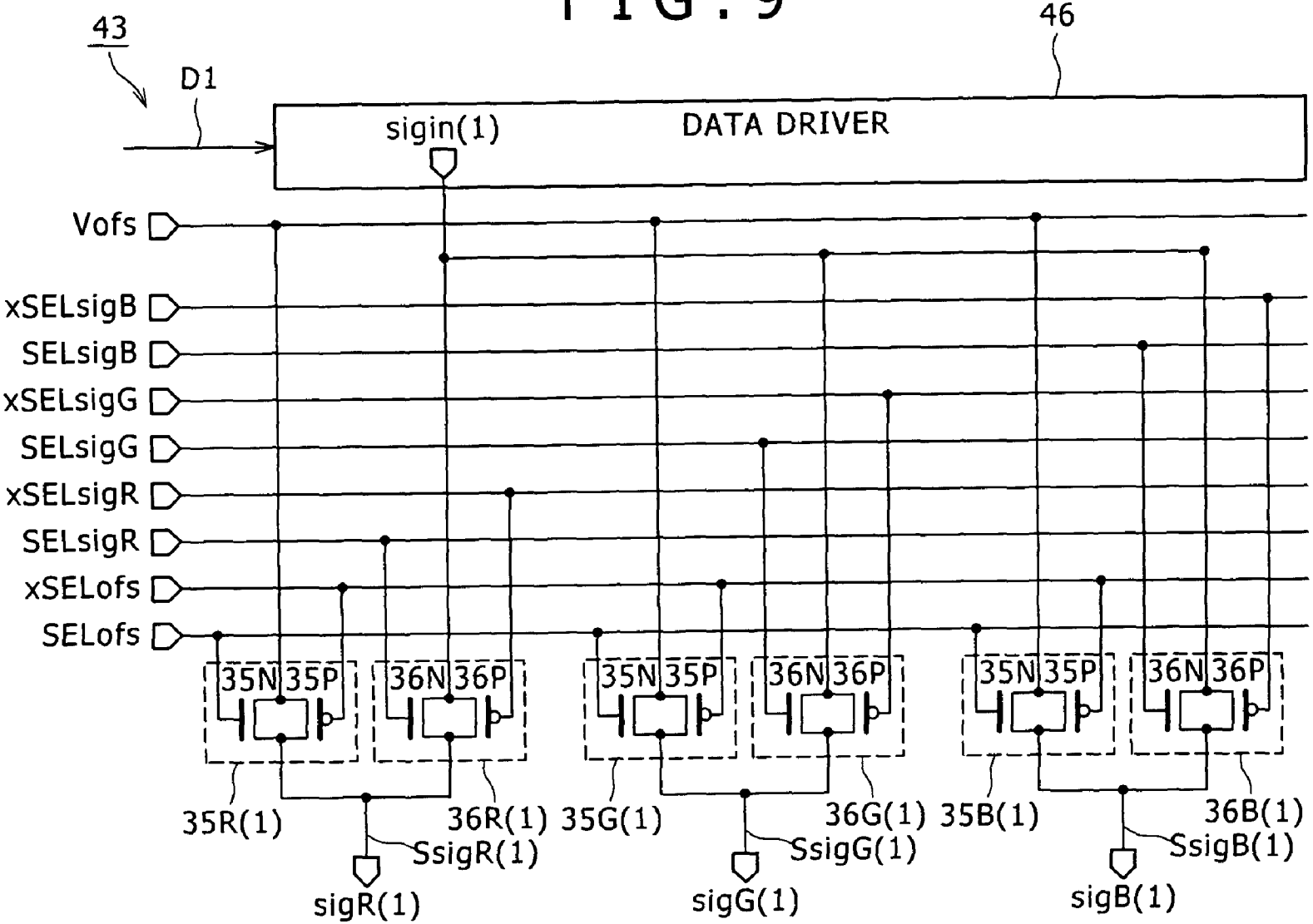
FIG. 9 is a circuit diagram, partly in block, showing a configuration of a signal line driving circuit which is applied to an image display device according to Embodiment 6 of the present invention.

FIG. 9 is a circuit diagram, partly in block, showing a configuration of a signal line driving circuit which is applied to an image display device according to Embodiment 6 of the present invention in contrast with the case of the signal line driving circuit in the image display device explained with reference to FIG. 5. The image display device of Embodiment 6 has the same configuration as that of the image display device of each of Embodiments 1 to 5 described above except for a difference of a configuration of a single line driving circuit 43.

Figures 10A, 10B, 10C, 10D, 10E, 10F, 10G, 10H, 10I, 10J:
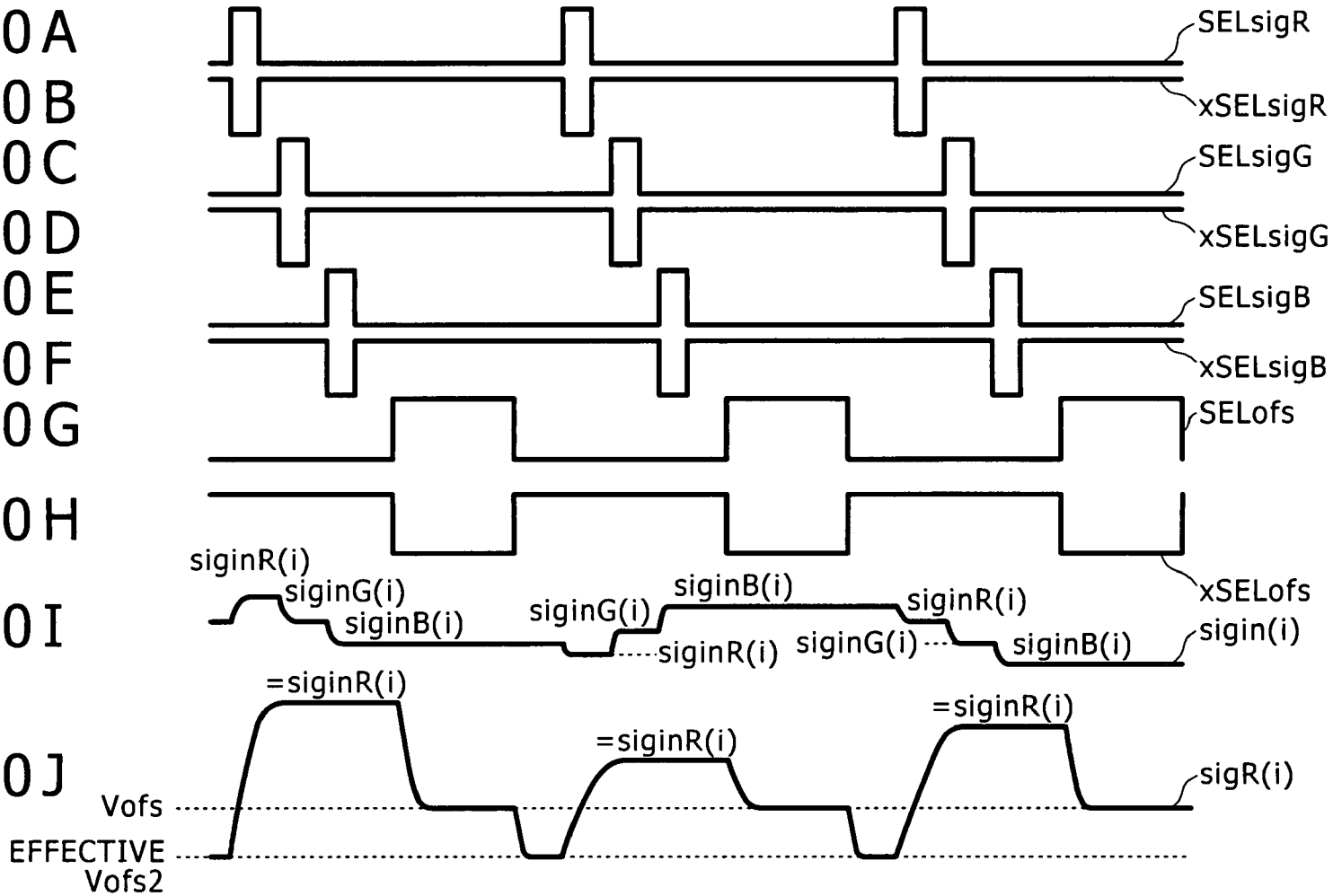
FIGS. 10A to 10J are a time chart explaining an operation of the signal line driving circuit shown in FIG. 9 which is applied to the image display device of Embodiment 6.
Figures 11A, 11B, 11C, 11D, 11E, 11F, 11G, 11H, 11I, 11J, 11K, 11L, 11M:
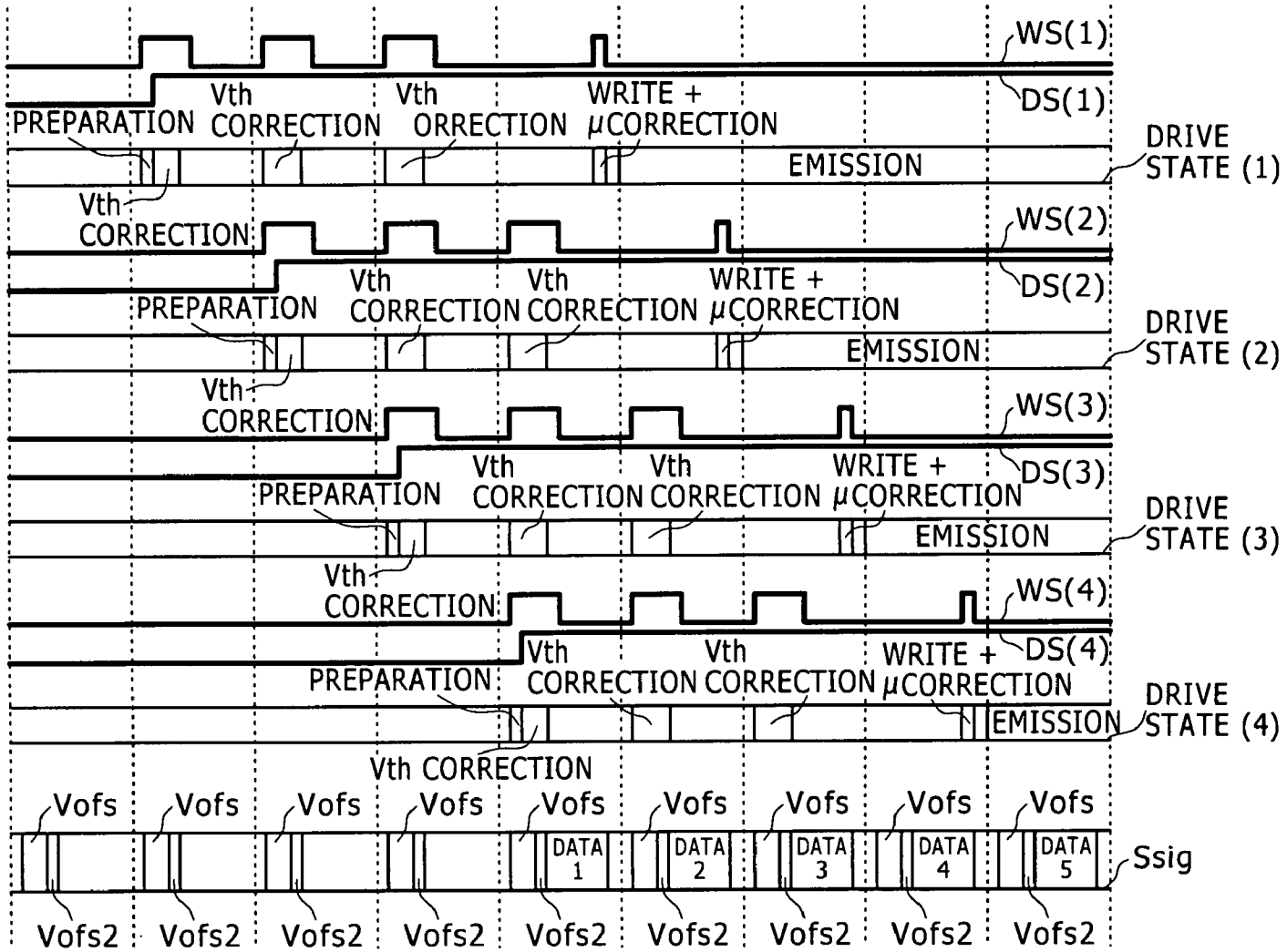
FIGS. 11A to 11M are a time chart explaining an operation of an image display device according to Embodiment 7 of the present invention.

In Embodiment 6, after successively latching image data D1 successively inputted thereto, and distributing the image data D1 thus latched among signal lines sig, a data driver 46 executes processing for digital-to-analog converting the image data D1, thereby generating a voltage Vsig for gradation setting every signal line sig. As shown in FIG. 10I, the data driver 46 multiplexes the voltages Vsig for gradation setting thus generated in a time division manner by using the three signal lines sig for red, green and blue which are wired continuously in a horizontal direction as a unit, thereby outputting an output signal sigin. As a result, in Embodiment 6, the number of output terminals in the data driver 46 is reduced to ⅓ of the number of signal lines sig, thereby simplifying the configuration of the image display device.

In addition, switches 36(1), 36(2) and 36(3) for outputting the fixed voltages Vofs to the three signal lines sig, respectively, are controlled so as to be turned ON/OFF in accordance with the control signals SELofs and xSELofs common thereto, thereby simultaneously setting each of the voltages of the three signal lines sig at the fixed voltage Vofs (refer to FIGS. 10G, 10H and 10J). In addition, the switches 35(1), 35(2) and 35(3) for outputting the voltages Vsig for gradation setting to the three signal lines sig, respectively, are controlled so as to be turned ON/OFF in a time division manner in accordance with control signals SELsigR and xSELsigR, control signals SELsigG and xSELsigG, and control signals SELsigB and xSELsigB, respectively (refer to FIGS. 10A to 10F, and 10J). Also, the voltages Vsig for gradation setting which are outputted from the data driver 46 through the time division multiplexing are outputted to the corresponding signal line sigR, sigG and sigB, respectively.

In the image display device of Embodiment 6, in each of the pixel circuits 5, the voltages developed across the opposite terminals of the hold capacitors Cs are simultaneously set at the voltages each equal to or higher than the threshold voltage Vth of the drive transistor Tr3 in the pixel circuits concerned with the three signal lines, respectively, so as to correspond to the configuration of the signal line driving circuit. After that, each of the voltages developed across the opposite terminals of the hold capacitors Cs is set at the threshold voltages Vth of the drive transistor Tr3 by carrying out the discharge through the drive transistor Tr3.

After that, the write transistors Tr1 are successively turned ON, thereby setting the voltages developed across the opposite terminals of the hold capacitors Cs.

In the signal line driving circuit of the image display device of Embodiment 6, the switch 35 and/or 36 has the same configuration as that in Embodiment 4 or 5 described above, thereby reducing the gate-to-source voltage of the drive transistor Tr3 for each of the pause time periods T1 and T2.

According to Embodiment 6, even when a plurality of signal lines are driven in the time division manner, it is possible to obtain the same effects as those in Embodiment 4 or Embodiment 5 described above.

Embodiment 7

It is noted that although in each of Embodiments 1 to 6 described above, the description has been given with respect to the case where the gate-to-source voltages of the drive transistors are temporarily reduced in accordance with the various settings for the write signal, the signal line driving circuit, and the like, thereby correcting the dispersion of the threshold voltages of the drive transistors, the present invention is by no means limited thereto. That is to say, the gate-to-source voltages of the drive transistors may be temporarily reduced based on a combination of the configurations of Embodiments 1 to 6 described above.

In addition, although in each of Embodiments 1 to 6 described above, the description has been given with respect to the case where the power source of the drive transistor is controlled in accordance with the control operation for the scanning lines, the present invention is by no means limited thereto. That is to say, a configuration may also be adopted such that a transistor is provided between the gate of the drive transistor and the power source, the power source for the drive transistor is controlled in accordance with the control operation of this transistor.

In addition, although in each of Embodiments 1 to 6 described above, the description has been given with respect to the case where the voltage of the power source for the drive transistor is caused to drop, and the electric charges accumulated in the organic EL element side end of the hold capacitor are discharged through the drive transistor, thereby causing the voltage, at the organic EL element side end, of the hold capacitor to drop, and the voltage developed across the opposite terminals of the hold capacitor is then set at the voltage equal to or higher than the threshold voltage of the drive transistor, the present invention is by no means limited thereto. That is to say, processing may also be adopted such that a transistor is provided at the organic EL element side end of the hold capacitor, and the voltage, at the organic EL element side end, of the hold capacitor is caused to drop in accordance with the ON/OFF control operation of this transistor, and the voltage developed across the opposite terminals of the hold capacitor is then set at the voltage equal to or higher than the threshold voltage of the drive transistor.

Although in each of Embodiments 1 to 6 described above, the description has been given with respect to the case where the electric charges corresponding to the voltage developed across the opposite terminals of the hold capacitor are discharged for the three time periods, thereby setting the voltage developed across the opposite terminals of the hold capacitor at the threshold voltage of the drive transistor, the present invention is by no means limited thereto. That is to say, the present invention can be generally applied to the case where the electric charges corresponding to the voltage developed across the opposite terminals of the hold capacitor are discharged for multiple time periods other than the three time periods, thereby setting the voltage developed across the opposite terminals of the hold capacitor at the threshold voltage of the drive transistor.

Although in each of Embodiments 1 to 6 described above, the description has been given with respect to the case where the electric charges corresponding to the voltage developed across the opposite terminals of the hold capacitor are discharged for the continuous time period for which the voltage of the signal line is set at the fixed voltage, thereby setting the voltage developed across the opposite terminals of the hold capacitor at the threshold voltage of the drive transistor, the present invention is by no means limited thereto. That is to say, as shown in FIGS. 11A to 11M, the time period for which the voltage of the signal line is set at the fixed voltage may be used as the pause time period as may be necessary. It is noted that the example shown in FIGS. 11A to 11M is such that the pause time period after the voltage developed across the opposite terminals of the hold capacitor is set at the threshold voltage of the drive transistor is prolonged, and subsequently, the time period for which the voltage of the signal line is set at the fixed voltage is also contained in the pause time period. By adopting this processing, the time period for display, and the time period for non-display can be freely set every line, and thus this process can be used as an improvement in judder, or the like.

In addition, although in each of Embodiments 1 to 6 described above, the description has been given so far with respect to the case where the N-channel transistor is applied to the drive transistor, the present invention is by no means limited thereto. That is to say, the present invention can be generally applied to an image display device in which the P-channel transistor is applied to the drive transistor, or the like. When the P-channel transistor is applied to the drive transistor, it goes without saying that a Hi voltage and a Lo voltage of the write signal WS are inverted in the pixel circuit of each of Embodiments 1 to 3 or the like because the P-channel transistor is applied to the write transistor Tr1 as well. In addition, in the case of Embodiment 4, Embodiment 5 or the like, it is also possible to readily understand that the relationship of the P-channel and N-channel of the transistors 35 and 36 are reversed.

In addition, although in each of Embodiments 1 to 6 described above, the description has been given so far with respect to the case where the present invention is applied to the image display device using the organic EL elements, the present invention is by no means limited thereto. That is to say, the present invention can be generally applied to image display devices using various current drive type self light emitting elements.

The present invention relates to the image display device and a method of driving the same, and for example, can be applied to the active matrix type image display device using the organic EL elements.

The present application contains subject matter related to that disclosed in Japanese Priority Patent Application JP 2008-101331 filed in the Japan Patent Office on Apr. 9, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image display device having a display portion formed by disposing pixel circuits in a matrix, and a signal line driving circuit and a scanning line driving circuit for driving said pixel circuits through signal lines and scanning lines of said display portion, said display portion, said signal line driving circuit and said scanning line driving circuit being formed on an insulating substrate, said pixel circuit comprising at least:

a light emitting element;

a drive transistor for current-driving said light emitting element by a drive current corresponding to a gate-to-source voltage of said drive transistor;

a hold capacitor composed of either one capacitor or a plurality of coupling capacitors for holding the gate-to-source voltage; and a write transistor adapted to be turned ON/OFF in accordance with a write signal outputted from said scanning line driving circuit, for setting a voltage developed across terminals of said hold capacitor at a voltage of corresponding one of said signal line;

wherein said signal line driving circuit alternately outputs a voltage for gradation setting used to instruct a gradation of said pixel circuit connected to the corresponding one of said signal lines, and a fixed voltage for threshold voltage correction to the corresponding one of said signal lines, in said pixel circuit, said write transistor is turned ON to set the voltage developed across said terminals of said hold capacitor at the fixed voltage, for setting the voltage developed across said terminals of said hold capacitor at a voltage equal to or higher than a threshold voltage of said transistor, a discharging operation for discharging electric charges corresponding to the voltage developed across said terminals of said hold capacitor through said drive transistor in a state in which said write transistor is turned ON to hold a voltage at one terminal of said hold capacitor at a given voltage for a time period for which a voltage of the corresponding one of said signal lines is set at the fixed voltage, and a turn-OFF operation of said write transistor for a time period for which the corresponding one of said signal lines is set at the voltage for gradation setting are repetitively carried out, the discharging operation is carried out at least twice or more, for setting the voltage developed across said terminals of said hold capacitor at a voltage depending on the threshold voltage of said drive transistor, said write transistor is turned ON to set the voltage developed across said terminals of said hold capacitor at the voltage for gradation setting, and for a time period for which the voltage of the corresponding one of said signal lines is set at the voltage for gradation setting within a time period from a time point at which the voltage developed across said terminals of said hold capacitor is set at the voltage equal to or higher than the threshold voltage to a time point at which the voltage developed across said terminals of said hold capacitor is set at the voltage for gradation setting, the voltage developed across said terminals of said hold capacitor is made variable from the fixed voltage by utilizing running between wiring patterns formed on said insulating substrate, for reducing the gate-to-source voltage of said write transistor as compared with that at a time point of end of the time point for which the voltage of the corresponding one of said signal lines is set at the fixed voltage.

2. The image display device according to claim 1, wherein the running between said wiring patterns is running from a gate line of said write transistor into a gate line of said drive transistor.

3. The image display device according to claim 2, wherein both said terminals of said hold capacitor are connected to a gate and a source of said drive transistor; and in said pixel circuit, electric charges accumulated in the light emitting element side end of said hold capacitor are caused to flow into a drain of said drive transistor in accordance with control for a drain voltage of said drive transistor, for setting a voltage at the light emission element side end of said hold capacitor at a predetermined voltage, and said write transistor is turned ON to set the voltage developed across said terminals of said hold capacitor at the fixed voltage, for setting the voltage developed across said terminals of said hold capacitor at a voltage equal to or higher than the threshold voltage of said drive transistor.

4. The image display device according to claim 2, wherein an amplitude of the write signal is increased as compared with a case where the voltage developed across said terminals of said hold capacitor is set at the voltage for gradation setting, to turn OFF said write transistor, for making the voltage developed across said terminals of said hold capacitor variable from the fixed voltage.

5. The image display device according to claim 4, wherein a timing at which the amplitude of the write signal is increased is a timing at which said write transistor is first turned OFF after the voltage developed across said terminals of said hold capacitor is set at a voltage equal to or higher than the threshold voltage of said drive transistor.

6. The image display device according to claim 4, wherein a voltage of the write signal is caused to rise to a high voltage as compared with a case where the voltage developed across said terminals of said hold capacitor is set at the voltage for gradation setting, for increasing the amplitude of the write signal.

7. The image display device according to claim 4, wherein said scanning line driving circuit causes a voltage of the write signal to drop to a low voltage as compared with a case where the voltage developed across said terminals of said hold capacitor is set at the voltage for gradation setting, for increasing the amplitude of the write signal.

8. The image display device according to claim 1, wherein said signal line driving circuit comprises:

a switch circuit, on a side of the voltage for gradation setting, configured to operate so as to be turned ON/OFF in accordance with a control signal on a side of the voltage for gradation setting, for outputting the voltage for gradation setting to the corresponding one of said signal lines; and a switch circuit, on a side of the fixed voltage, configured to operate so as to be turned ON/OFF in accordance with a control signal on a side of the fixed voltage, for outputting the fixed voltage to the corresponding one of said signal lines; and the running between said wiring patterns formed on said insulating substrate is running from a wiring pattern for a control signal on the side of the fixed voltage into a wiring pattern of the corresponding one of said signal lines.

9. The image display device according to claim 8, wherein both said terminals of said hold capacitor are connected to a gate and a source of said drive transistor; and in said pixel circuit, electric charges accumulated in the light emitting element side end of said hold transistor are caused to flow into a drain of said drive transistor in accordance with control for a drain voltage of said drive transistor, for setting a voltage at the light emitting element side end of said hold capacitor at a predetermined voltage, and said write transistor is turned ON to set the voltage developed across said terminals of said hold capacitor at the fixed voltage, for setting the voltage developed across said terminals of said hold capacitor at a voltage equal to or higher than the threshold voltage of said drive transistor.

10. The image display device according to claim 8, wherein said switch circuit on the side of the fixed voltage is composed of a P-channel transistor and an N-channel transistor which operate so as to be turned ON/OFF in accordance with the control signal on the side of the fixed voltage; and a gate area of said N-channel transistor is set so as to be larger than that of said P-channel transistor.

11. The image display device according to claim 8, wherein said switch circuit on the side of the voltage for gradation setting is composed of a P-channel transistor and an N-channel transistor which operate so as to be turned ON/OFF in accordance with the control signal on the side of the voltage for gradation setting;

said switch circuit on the side of the fixed voltage is composed of a P-channel transistor and an N-channel transistor which operate so as to be turned ON/OFF in accordance with the control signal on the side of the fixed voltage; and a ratio of a gate area of said N-channel transistor to a gate area of said P-channel transistor in said switch circuit on the side of the fixed voltage is set so as to be larger than that of a gate area of said N-channel transistor to a gate area of said P-channel transistor in said switch circuit on the side of the voltage for gradation setting.

12. The image display device according to claim 8, wherein said switch circuit on the side of the voltage for gradation setting is composed of an N-channel transistor which operates so as to be turned ON/OFF in accordance with the control signal on the side of the voltage for gradation setting;

said switch circuit on the side of the fixed voltage is composed of an N-channel transistor which operates so as to be turned ON/OFF in accordance with the control signal on the side of the fixed voltage; and a gate area of said N-channel transistor in said switch circuit on the side of the fixed voltage is set so as to be larger than that of said N-channel transistor in said switch circuit on the side of the voltage for gradation setting.

13. The image display device according to claim 8, wherein said switch circuit on the side of the fixed voltage is composed of a P-channel transistor and an N-channel transistor which operate so as to be turned ON/OFF in accordance with the control signal on the side of the fixed voltage; and an amplitude of the control signal in accordance with which said N-channel transistor is controlled so as to be turned ON/OFF is set so as to be larger than that of the control signal in accordance with which said P-channel transistor is controlled so as to be turned ON/OFF.

14. The image display device according to claim 8, wherein said switch circuit on the side of the voltage for gradation setting is composed of a P-channel transistor and an N-channel transistor which operate so as to be turned ON/OFF in accordance with the control signal on the side of the voltage for gradation setting;

said switch circuit on the side of the fixed voltage is composed of a P-channel transistor and an N-channel transistor which operate so as to be turned ON/OFF in accordance with the control signal on the side of the fixed voltage; and a ratio of an amplitude of the control signal in accordance with which said N-channel transistor is turned ON/OFF to an amplitude of the control signal in accordance with which said P-channel transistor is turned ON/OFF in said switch circuit on the side of the fixed voltage is set so as to be larger than that of an amplitude of the control signal in accordance with which said N-channel transistor is turned ON/OFF to an amplitude of the control signal in accordance with which said P-channel transistor is turned ON/OFF in said switch circuit on the side of the voltage for gradation setting.

15. The image display device according to claim 8, wherein said switch circuit on the side of the voltage for gradation setting is composed of an N-channel transistor which operates so as to be turned ON/OFF in accordance with the control signal on the side of the voltage for gradation setting;

said switch circuit on the side of the fixed voltage is composed of an N-channel transistor which operates so as to be turned ON/OFF in accordance with the control signal on the side of the fixed voltage; and an amplitude of the control signal in accordance with which said N-channel transistor in said switch circuit on the side of the fixed voltage is turned ON/OFF is set so as to be larger than that of the control signal in accordance with which said N-channel transistor in said switch circuit on the side of the voltage for gradation setting is turned ON/OFF.

16. A method of driving an image display device having a display portion formed by disposing pixel circuits in a matrix, and a signal line driving circuit and a scanning line driving circuit for driving said pixel circuits through signal lines and scanning lines of said display portion, said display portion, said signal line driving circuit and said scanning line driving circuit being formed on an insulating substrate, said pixel circuit including at least a light emitting element, a drive transistor for current-driving said light emitting element by a drive current corresponding to a gate-to-source voltage of said drive transistor, a hold capacitor composed of either one capacitor or a plurality of coupling capacitors for holding the gate-to-source voltage, and a write transistor adapted to be turned ON/OFF in accordance with a write signal outputted from said scanning line driving circuit, for setting a voltage developed across terminals of said hold capacitor at a voltage of corresponding one of said signal lines, said driving method comprising the steps of:

alternately outputting a voltage for gradation setting used to instruct a gradation of said pixel circuit connected to the corresponding one of said signal lines, and a fixed voltage for threshold voltage correction from said signal line driving circuit to the corresponding one of said signal lines;

turning ON said write transistor to set the voltage developed across said terminals of said hold capacitor at the fixed voltage, for setting the voltage developed across said terminals of said hold capacitor at a voltage equal to or higher than a threshold voltage of said drive transistor;

repetitively carrying out a discharging operation for discharging electric charges corresponding to the voltage developed across said terminals of said hold capacitor through said drive transistor in a state in which said write transistor is turned ON to hold a voltage at one terminal of said hold capacitor at a given voltage for a time period for which a voltage of the corresponding one of said signal lines is set at the fixed voltage, and a turn-OFF operation of said write transistor for a time period for which the voltage of the corresponding one of said signal lines is set at the voltage for gradation setting so as to follow the second step, and carrying out the discharging operation at least twice or more, for setting the voltage developed across said terminals of said hold capacitor at a voltage depending on the threshold voltage of said drive transistor; and turning ON said write transistor so as to follow the third step, for setting the voltage developed across said terminals of said hold capacitor at the voltage for gradation setting;

wherein in the third step, for a time period for which the voltage of the corresponding one of said signal lines is set at the voltage for gradation setting, the voltage developed across said terminals of said hold capacitor is made variable from the fixed voltage by utilizing running between wiring patterns formed on said insulating substrate, for reducing the gate-to-source voltage of said write transistor as compared with that at a time point of end of the time period for which the voltage of the corresponding one of said signal lines is set at the fixed voltage.

* * * * *